US010436183B2

(12) United States Patent
Yamazaki et al.

(10) Patent No.: US 10,436,183 B2
(45) Date of Patent: Oct. 8, 2019

(54) PLASMA ACCELERATING APPARATUS AND PLASMA ACCELERATING METHOD

(71) Applicants: MITSUBISHI HEAVY INDUSTRIES, LTD., Tokyo (JP); National University Corporation Nagoya University, Aichi (JP)

(72) Inventors: Takuya Yamazaki, Tokyo (JP); Matsutaka Sasahara, Tokyo (JP); Tomoji Iwasaki, Tokyo (JP); Masaaki Yasui, Tokyo (JP); Akihiro Sasoh, Aichi (JP); Akira Iwakawa, Aichi (JP); Daisuke Ichihara, Aichi (JP); Keisuke Mizutani, Aichi (JP)

(73) Assignees: MITSUBISHI HEAVY INDUSTRIES, LTD., Tokyo (JP); NATIONAL UNIVERSITY CORPORATION NAGOYA UNIVERSITY, Aichi (JP)

( * ) Notice: Subject to any disclaimer, the term of this patent is extended or adjusted under 35 U.S.C. 154(b) by 0 days.

(21) Appl. No.: 16/066,899

(22) PCT Filed: Jan. 6, 2017

(86) PCT No.: PCT/JP2017/000323
§ 371 (c)(1),
(2) Date: Jun. 28, 2018

(87) PCT Pub. No.: WO2017/119501
PCT Pub. Date: Jul. 13, 2017

(65) Prior Publication Data

US 2019/0010933 A1 Jan. 10, 2019

(30) Foreign Application Priority Data

Jan. 8, 2016 (JP) ..... 2016-002734

(51) Int. Cl.
*H01J 7/24* (2006.01)
*F03H 1/00* (2006.01)
(Continued)

(52) U.S. Cl.
CPC ..... *F03H 1/0062* (2013.01); *F03H 1/0012* (2013.01); *F03H 1/0068* (2013.01); *H05H 1/54* (2013.01); *H05H 1/04* (2013.01)

(58) Field of Classification Search
CPC ..... H05H 1/04; H05H 1/54; H05H 15/00
(Continued)

(56) References Cited

U.S. PATENT DOCUMENTS 5,557,172 A 9/1996 Tanaka
5,845,880 A 12/1998 Petrosov et al.
(Continued)

FOREIGN PATENT DOCUMENTS

JP 7-192888 7/1995
JP 2001-511580 8/2001
(Continued)

OTHER PUBLICATIONS

Notification of Transmittal of Translation of the International Preliminary Report on Patentability dated Jul. 10, 2018 in International Application No. PCT/JP2017/000323.
(Continued)

*Primary Examiner* — Thuy V Tran
(74) *Attorney, Agent, or Firm* — Wenderoth, Lind & Ponack, L.L.P.

(57) ABSTRACT

A plasma accelerating apparatus includes: a cathode (11) configured to supply electrons to a plasma acceleration region; an anode (12); a power supply (13) configured to apply a voltage between the cathode and the anode; a supply port (14) arranged on an outer circumference side of the cathode to supply a propellant to the plasma acceleration
(Continued)

region; and a first magnetic field generator (15) configured to generate a first axial direction magnetic field in the upstream side region of the plasma acceleration region to suppress electrons supplied from the cathode from heading for the anode. Thus, the plasma accelerating apparatus and the plasma accelerating method having high thrust efficiency is provided.

12 Claims, 21 Drawing Sheets

(51) Int. Cl.
*H05H 1/54* (2006.01)
*H05H 1/04* (2006.01)

(58) Field of Classification Search
USPC ..... 315/111.41
See application file for complete search history.

(56) References Cited

U.S. PATENT DOCUMENTS

| | | | | |
|---|---|---|---|---|
| 6,238,537 | B1 * | 5/2001 | Kahn | C23C 14/228 204/298.04 |
| 6,456,011 | B1 * | 9/2002 | Bugrova | H01J 27/143 250/423 R |
| 7,624,566 | B1 * | 12/2009 | Manzella | H05H 1/54 60/202 |
| 2015/0305132 | A1 * | 10/2015 | Mitra | H05H 1/48 313/231.31 |

FOREIGN PATENT DOCUMENTS

| | | |
|---|---|---|
| JP | 2002-504968 | 2/2002 |
| JP | 4925132 | 4/2012 |
| JP | 2015-222705 | 12/2015 |

OTHER PUBLICATIONS

International Search Report dated Mar. 7, 2017 in International (PCT) Application No. PCT/JP2017/000323.

* cited by examiner

PLASMA ACCELERATING APPARATUS AND PLASMA ACCELERATING METHOD

TECHNICAL FIELD

The present invention related to a plasma accelerating apparatus and a plasma accelerating method.

BACKGROUND ART

In the space, a plasma accelerating apparatus is used for the spacecraft to get a thrust. As the plasma accelerating apparatus, for example, a Hall thruster is known. For example, the Hall thruster generates an electric field and a magnetic field in an acceleration channel (a plasma acceleration region) and changes (plasmatizes) a propellant into plasma by using interaction of the electric field and the magnetic field. The Hall thruster acquires the thrust by expelling ions in the plasma into the space on a downstream side from the Hall thruster.

As the related technique, Patent Literature 1 discloses a Hall current ion source apparatus. The Hall current ion source apparatus of Patent Literature 1 has, for example, a magnetic field generating unit which contains an electromagnet and a steel core assembly. By arranging the magnetic field generating unit on the central axis of the Hall thruster, a radial direction magnetic field is generated.

Also, to generate the acceleration electric field, the Hall current ion source apparatus further has an anode and a cathode in addition to the magnetic field generating unit. The anode is arranged on the upstream side from the acceleration channel. On the other hand, the cathode is arranged on the downstream side from the acceleration channel.

CITATION LIST

[Patent Literature 1] JP 2001-511580A

SUMMARY OF THE INVENTION

The inventors of the present invention were looking for a plasma accelerating apparatus and a plasma accelerating method that have a high propulsion efficiency.

An object of the present invention is to provide the plasma accelerating apparatus and the plasma accelerating method that have the high thrust efficiency.

The plasma accelerating apparatus in some embodiments includes a cathode configured to supply electrons to an upstream side region of a plasma acceleration region; an anode; a power supply configured to apply a voltage between the cathode and the anode; a supply port arranged on an outer circumference side than the cathode to supply a propellant before plasmatization or a propellant after plasmatization to the plasma acceleration region; and a first magnetic field generator configured to generate a first axial direction magnetic field in the upstream side region of the plasma acceleration region to suppress that the electrons supplied from the cathode head for the anode.

A first direction is defined as a direction which heads for the downstream side region of the plasma acceleration region from the upstream side region of the plasma acceleration region, and a second direction is defined as a direction opposite to the first direction. The first magnetic field generator may be arranged in the second direction from an end of the plasma acceleration region in the second direction.

The first magnetic field generator may be arranged on the outer circumference side than the cathode. The supply port may be arranged on the outer circumference side than the first magnetic field generator.

The supply port may be arranged on the outer circumference side than the cathode. The first magnetic field generator may be arranged on the outer circumference side than the supply port.

The plasma accelerating apparatus may further include an orientation changing mechanism configured to change an orientation of the first magnetic field generator.

The plasma accelerating apparatus may further include second magnetic field generators ($\mathbf{15}_2$-$\mathbf{15}_5$) configured to generate a second axial direction magnetic field in the plasma acceleration region.

The direction of the second axial direction magnetic field generated by the second magnetic field generator may be different from the direction of the first axial direction magnetic field generated by the first magnetic field generator.

The plasma accelerating apparatus may further include a first wall section in contact with the plasma acceleration region; and an electron emission port arranged in the first wall section to emit the electrons supplied from the cathode.

The anode may be arranged on the first wall section.

The anode may be arranged on the outer circumference side than the supply port.

The plasma accelerating apparatus may further include a first wall section in contact with the plasma acceleration region. The anode may have a ring shape.

A distance between the first wall section and a downstream side end surface of the anode may be equal to or less than ⅓ of the inner diameter of the anode.

A plasma accelerating method in some embodiments uses a plasma accelerating apparatus.

The plasma accelerating apparatus includes an anode, a cathode configured to supply electrons to a plasma acceleration region; and a magnetic field generator arranged in a second direction from the plasma acceleration region when a first direction is defined as a direction of the movement of electrons emitted from the cathode and the second direction is defined as a direction opposite to the first direction. The plasma accelerating method includes generating a fan-shaped magnetic field in the plasma acceleration region by using the magnetic field generator; applying a voltage between the cathode and the anode; carrying out a first supply of supplying the electrons supplied from the cathode into the fan-shaped magnetic field; carrying out a second supply of supplying a propellant before plasmatization or a propellant after plasmatization into the plasma acceleration region; accelerating ions in a plasma generated in the plasma acceleration region by using an electric field generated by the anode and the electrons in the fan-shaped magnetic field; and neutralizing the ions through collision of the ions and the electrons in the fan-shaped magnetic field.

The plasma accelerating method may further include generating a Hall current through interaction of the fan-shaped magnetic field and the electric field generated between the cathode and the anode; and generating the plasma in the plasma acceleration region through collision of a propellant before plasmatization or a propellant after plasmatization supplied into the plasma acceleration region and the electrons of the Hall current.

Effect of the Invention

The plasma accelerating apparatus and the plasma accelerating method, that have the high thrust efficiency are provided.

DESCRIPTION OF EMBODIMENTS

Figure 1:
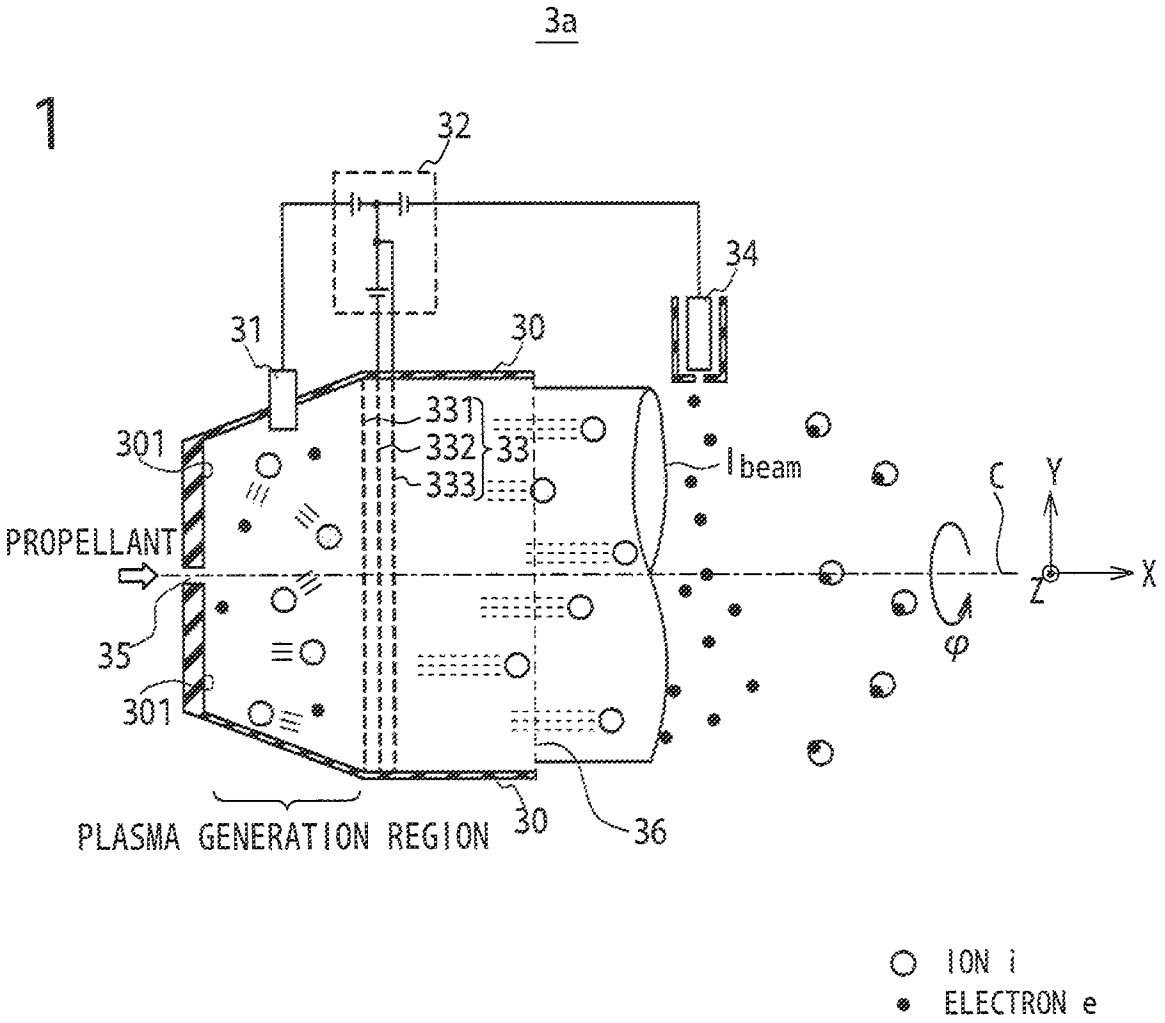
FIG. 1 is a longitudinal cross-sectional view schematically showing a configuration example of an ion thruster 3*a*.

Hereinafter, the embodiments of the present invention will be described in conjunction with the attached drawings. In the following embodiments, an identical reference numeral is principally assigned to an identical member and repetitive description is omitted. Also, a suffix is sometimes used to distinguish an identical type of members.

Figure 4:
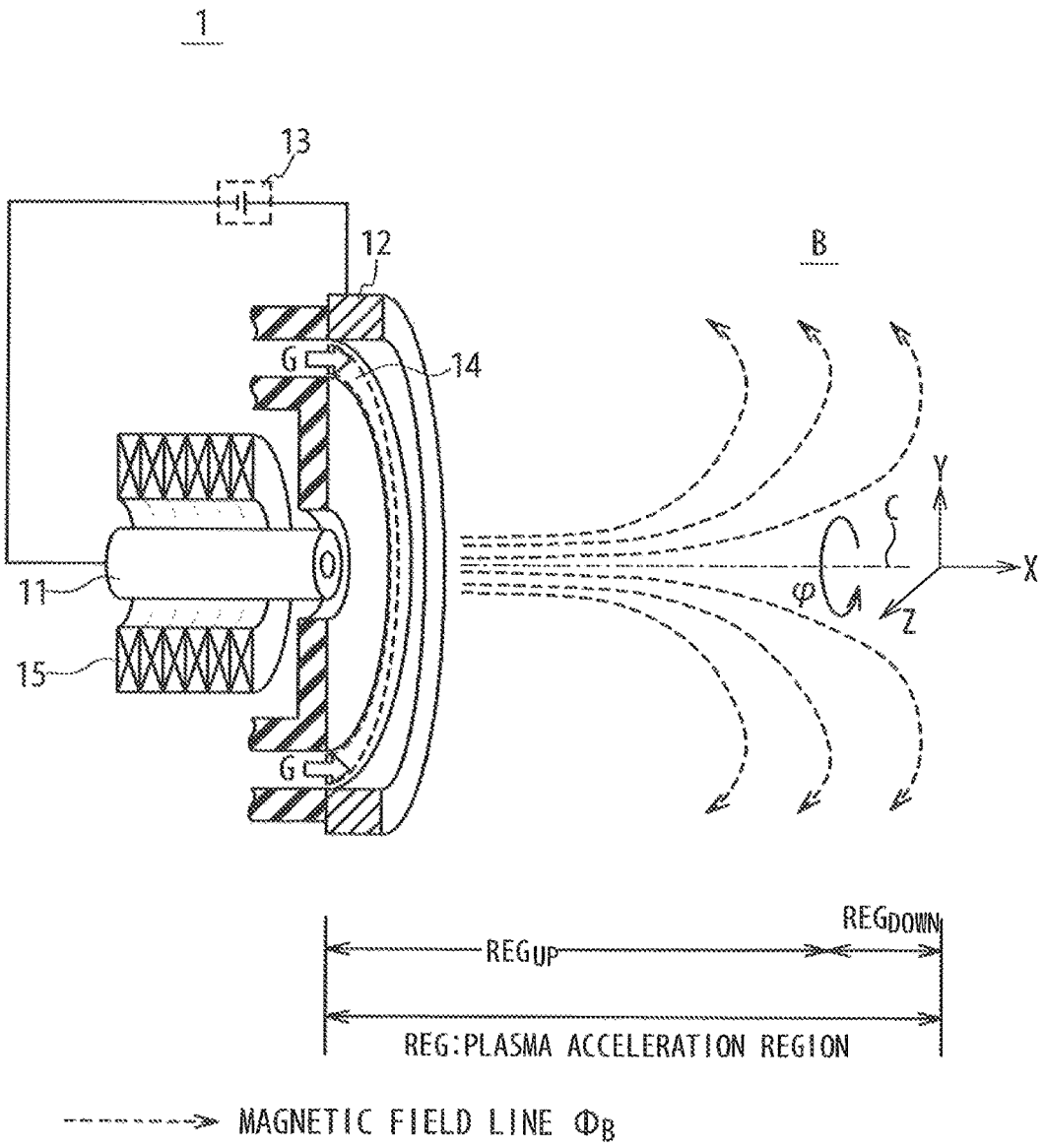
FIG. 4 is a partially cut perspective view schematically showing a basic configuration of a plasma accelerating apparatus 1.

To make the description of the embodiments easy to understand, the following words and phrases are defined with reference to FIG. 4. The definition of the following words and phrases would become clearer with reference to the whole Specification of the present invention and the whole drawings.

1) For example, a central axis C is an axis showing the center of a plasma accelerating apparatus 1.

2) A coordinate system is a rectangular coordinate system having an X axis, a Y axis and a Z axis. For example, the X axis is a rotation symmetry axis and coincides with the central axis C.

3) For example, "a downstream side" implies the positive (+) direction to the X axis. For example, a phrase of "a downstream side than a gas supply port 14" implies the positive direction of the X axis, viewing from the gas supply port 14. "The upstream side" implies a side opposite to the downstream side.

4) For example, a radial direction is a direction from an optional point on the central axis C (the X axis) toward an outer optional point above the central axis C (the X axis), and perpendicular to the central axis C (the X axis).

1. Items Recognized by Inventors of the Present Invention

As a plasma accelerating apparatus, an ion thruster is known in addition to a Hall thruster. Regarding the ion thruster and the Hall thruster, the inventors of the present invention recognized the following items.

(Ion Thruster)

The ion thruster will be described. FIG. 1 is a longitudinal cross-sectional view schematically showing a configuration example of an ion thruster 3*a*. As shown in FIG. 1, the ion thruster 3*a* includes a wall section 30, an anode 31, a power supply 32, a grid electrode 33, a neutralizer 34, a supply port 35 and an expelling port surface 36. In an example of FIG. 1, the grid electrode 33 is configured of a first grid electrode (a screen grid electrode) 331, a second grid electrode (an accelerator grid electrode) 332, and a third grid electrode (a decel grid electrode) 333. Briefly saying, the ion thruster 3*a* is configured to accelerate ions of a propellant plasmatized by using an electric field (an electrostatic field). In the description of FIG. 1, a region from an inner wall 301 to the first grid electrode 331 is called a plasma generation region.

The operation principle of the ion thruster 3*a* is roughly divided into three steps. A first step is related to the generation of plasma. As shown in FIG. 1, the propellant (e.g. xenon gas) is supplied to the plasma generation region from the supply port 35. Because the electric power for plasma generation is supplied from the power supply 32 to the anode 31 and a cathode (not shown) for plasma generation and discharge, the propellant is plasmatized through discharging between the anode 31 and the cathode for plasma generation and discharge. As a result, the plasma generation region is filled by ions (cations i) and electrons (e) of the plasmatized propellant.

A second step is related to the extraction of ions. In the example of FIG. 1, the first grid electrode 331 is connected with the power supply to be set to a negative potential to the plasma in the plasma generation region. The second grid electrode 332 is supplied with a negative voltage from the power supply 32. The third grid electrode 333 is connected to be set to a positive potential which is higher than the potential of the second grid electrode 332. As a result, the ions in the plasma generation region are accelerated for the second grid electrode 332. The ions pass through holes in each of the three grid electrodes (331 to 333) and move for the downstream side. In other words, the ions are extracted from the plasma in the plasma generation region. The extracted ions are expelled for the downstream side than the expelling port surface 36 as an ion beam. $I_{beam}$.

A third step is related to the neutralization of the ions expelled from the expelling port surface 36. By the above-mentioned extraction of ions, the number of electrons in the plasma generation region becomes more than the number of ions in the plasma generation region. As a result, the ion thruster 3*a* (the wall section 30) is charged to a negative potential. The neutralizer 34 is used to keep an electrically neutral condition of the ion thruster 3*a*. The neutralizer 34 is arranged on the downstream side than the expelling port surface 36 of the ion thruster, and expels electrons in response to the supply of a negative voltage from the power supply 32. Through coupling of the ions of the ion beam $I_{beam}$ and the electrons emitted from the neutralizer 34, the ion beam $I_{beam}$ is neutralized.

There are the following problems in the ion thruster. First, the grid electrode is easy to waste. One of the reasons is as follows. All the ions in the plasma generation region do not always pass through holes of each of the three grid electrodes (331-333). A part of the ions collides with any of the grid electrodes. This does not only cause the waste of the grid electrode but also shortens a life of the ion thruster. Second, it is difficult to raise the propulsion of the ion thruster without changing the size of the ion thruster. This is caused from the following reason. The propulsion of the ion thruster is proportional to a current generated by the ion beam $I_{beam}$ of FIG. 1 (called an ion beam current). Therefore, if the size of the ion thruster is identical, the propulsion of the ion thruster increases as the ion beam current increases. To increase the ion beam current, it is enough to increase a supply amount of the propellant to generate the plasma. However, it is known that there is an upper limit of the ion beam current because of the spatial charge limiting law. In other words, if the size of the ion thruster is identical, there is a limitation in the propulsion of the ion thruster.

(Annular-Type Hall Thruster)

Figure 2:
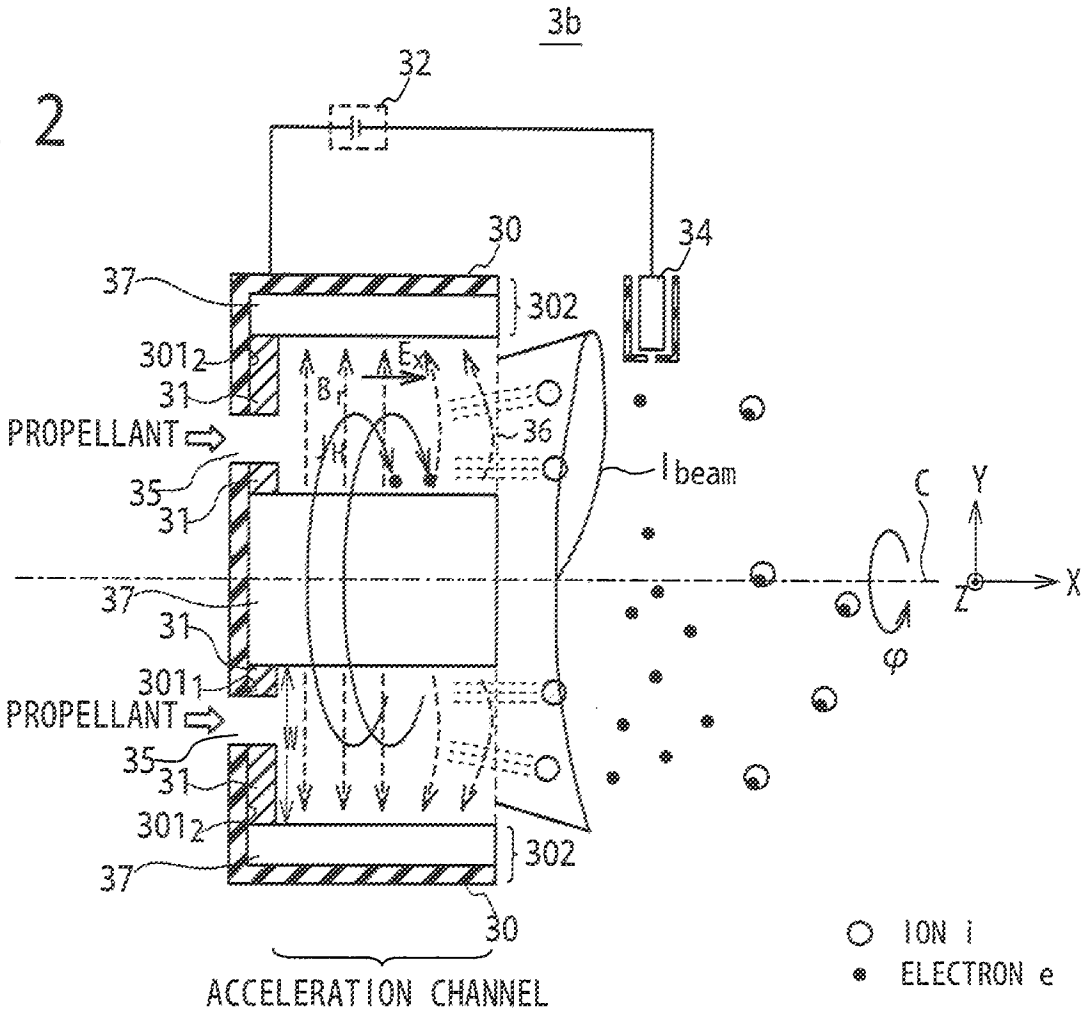
FIG. 2 is a longitudinal cross-sectional view schematically showing a configuration example of an annular-type Hall thruster 3*b*.

A Hall thruster will be described. The Hall thruster is of some types. Here, an annular-type Hall thruster is raised as an example. FIG. 2 is a longitudinal cross-sectional view schematically showing a configuration example of the annular-type Hall thruster 3*b*. As shown in FIG. 2, the annular-type Hall thruster 3*b* includes the wall section 30 to configure an acceleration channel, the anode 31, the power supply 32, the neutralizer 34, the supply port 35, the expelling port surface 36, and a magnetic field generator 37. Simply speaking, the annular-type Hall thruster 3*b* is configured to plasmatize the propellant by using interaction of an electric field and a magnetic field, and to accelerate ions in the plasma by using the interaction of a drift current of electrons (current generated by the electrons captured by the magnetic field, and moving due to influence of the electric field) and the magnetic field.

The annular-type Hall thruster 3*b* shown in FIG. 2 is different from the ion thruster 3*a* shown in FIG. 1 in the following points. In the first point, to plasmatize the propellant, the Hall current (the Hall movement of electrons) generated by the interaction of the electric field and the magnetic field is used. To generate the Hall current $J_H$, the electric field $E_x$ in the axial direction and the magnetic field $B_r$ in the radial direction are given to be orthogonal to each other. In the second point, the ions of the propellant plasmatized by the Hall current $J_H$ are accelerated by Lorentz force. The Lorentz force is one of the interactions of the Hall current $J_H$ and the magnetic field $B_r$ in the radial direction. Note that this Lorentz force is equal to electrostatic force which acts on the ion by the electric field. In an example of FIG. 2, the generation of Hall current $J_H$ and the acceleration of the ions are carried out in a region called an acceleration channel.

The radial direction magnetic field $B_r$ which is necessary for generation of the Hall current $J_H$ is obtained by a magnetic field generator 37. In the example of FIG. 2, the radial direction magnetic field $B_r$ is a magnetic field to the direction of a side wall 302 from the central axis C of the wall section 30. In the example of FIG. 2, a part of the magnetic field generator 37 is arranged along the central axis C. The remaining part of the magnetic field generator 37 is arranged along the side wall 302 having a circular cylindrical shape.

On the other hand, the axial direction electric field $E_x$ which is used to generate the Hall current $J_H$ is obtained by the anode 31 and the neutralizer 34. In the example of FIG. 2, a part of the anode 31 is arranged on the inner wall $\mathbf{301}_1$ on the side of the inner circumference. The remaining part of the anode 31 is arranged on an inner wall $\mathbf{301}_2$ on the side of the outer circumference.

The operation principle of the annular-type Hall thruster 3*b* is roughly divided into four steps. A first step is related to the generation of the Hall current. As shown in FIG. 2, the electrons emitted from the neutralizer 34 enter the acceleration channel by the axial direction electric field $E_x$. The electrons which have entered the acceleration channel are captured by the radial direction magnetic field $B_r$ and carry out E×B drift movement. As a result, the electrons in the acceleration channel turns around the central axis C. By the rotary motion of the electrons, the Hall current $J_H$ is generated around the central axis C.

A second step is related to plasmatization of the propellant. When the propellant is supplied to the acceleration channel from the supply port 35, the propellant collides with the electrons of the Hall current $J_H$, to plasmatize the propellant. As a result, the acceleration channel is filled with the ions (i) and electrons (e) of the plasmatized propellant.

A third step is related to the acceleration of the ions. The ions of the plasmatized propellant receive Lorentz force and are accelerated for the expelling port surface 36. After that, the accelerated ions are expelled for the downstream direction from the expelling port surface 36 as the ion beam $I_{beam}$.

A fourth step is related to the neutralization of the ions expelled from the expelling port surface 36, like the case of the ion thruster shown in FIG. 1. In the annular-type Hall thruster 3*b*, too, the ion beam $I_{beam}$ is neutralized by the neutralizer 34.

As described above, the Hall thruster does not need, a grid electrode. Therefore, the Hall thruster has an advantage that the Hall thruster does not receive restriction of the ion beam current by the spatial charge limiting law. On the contrary, there are the following problems in the Hall thruster.

First, the energy loss of the ion beam occurs. One of the reasons is because a part of the plasma in the acceleration channel collides with the side wall. This collision causes the degradation of side wall itself addition to the energy loss of the ion beam.

Second, the ion beam is easy to spread to the radial direction. This causes the down of the propulsion. The reason is in that all ions in the acceleration channel do not always have momentum in an axial direction (momentum in the X axial direction). A part of the ions has momentum in the radial direction. Therefore, the ion beam is easy to spread to the radial direction.

Third, the increase of the Hall thruster in size is difficult in case of the annular-type Hall thruster. In other words, there is a limitation in increase of the propulsion of the Hall thruster due to the structure. This is because of the following reason. To accomplish a desired ion beam, it is necessary to keep plasma pressure (the pressure of the plasmatized propellant) in the acceleration channel at an appropriate value. However, there is a limitation in the Rama radius in which a permissible value of the grid width W shown in FIG. 2 is in inverse proportion to the intensity of the magnetic field applied between the grids (between the magnetic field generator 37 and the side wall 302). Therefore, regarding the size of the Hall thruster, the degrees of freedom of the design is low.

(Cylindrical-Type Hall Thruster)

Figure 3:
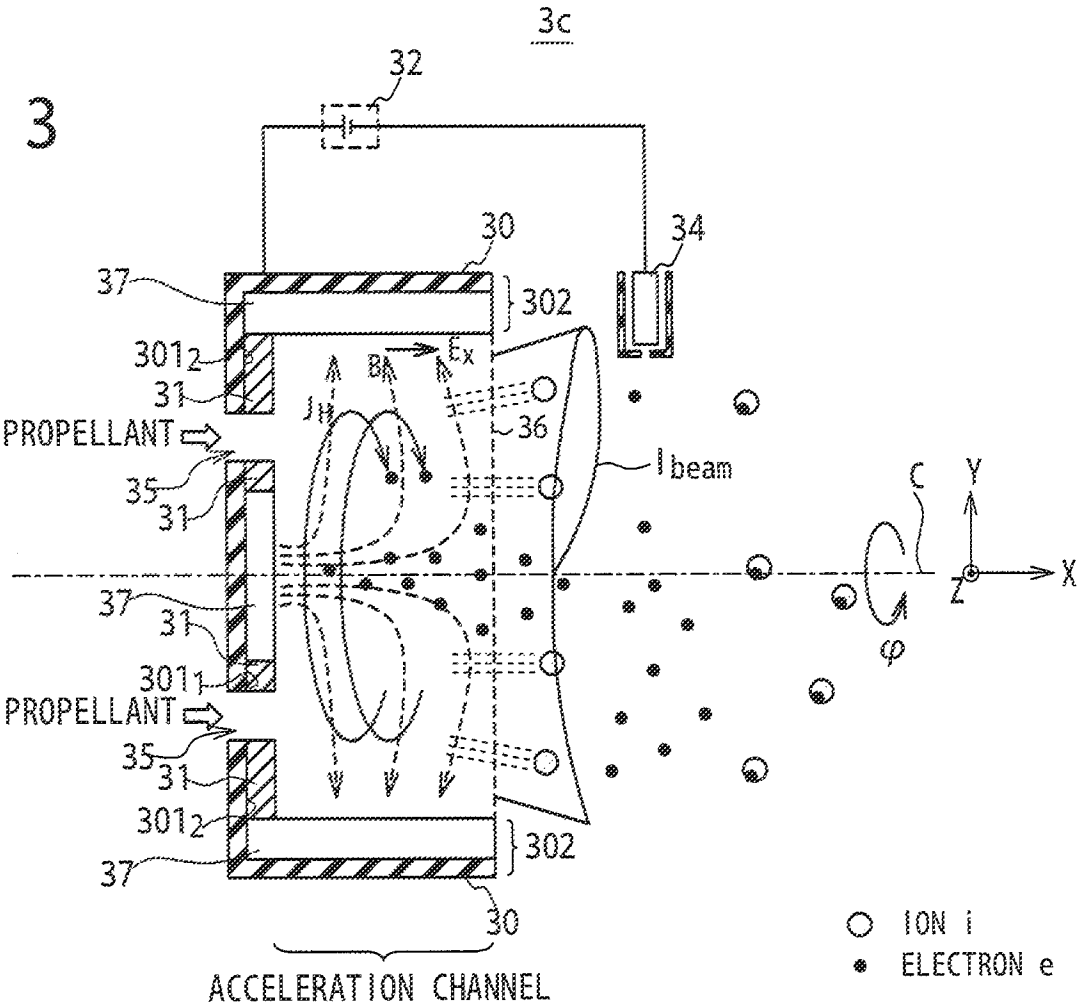
FIG. 3 is a longitudinal cross-sectional view schematically showing a configuration example of a cylindrical-type Hall thruster 3*c*.

As the type of the Hall thruster, there is a cylindrical type in addition to the annular type. The cylindrical type will be described, FIG. 3 is a longitudinal cross-sectional view schematically showing a configuration example of the cylindrical-type Hall thruster 3*c*. Regarding the configuration and the operation principle, the cylindrical-type Hall thruster 3*c* shown in FIG. 3 is similar to the annular-type Hall thruster 3*b* shown in FIG. 2. The difference between both is in a distribution of the magnetic field. In the example of FIG. 2, the radial direction magnetic field $B_r$ is generated in the acceleration channel. On the other hand, in an example of FIG. 3, the magnetic field having a shape like the cusp magnetic field is generated in the acceleration channel. To generate such a magnetic field, the shape of the magnetic field generator 37 arranged on the inner wall $\mathbf{301}_1$ on the internal circumference side is different from the example shows in FIG. 2.

Compared with the annular-type Hall thruster, the cylindrical-type Hall thruster has a large value of (the volume of discharge chamber)/(the surface area of discharge chamber) due to its structure. Therefore, the wearing out of the wall due to collision of ions with the wall of the discharge chamber is difficult to occur. On contrary, there is the following problem in the cylindrical-type Hall thruster, in addition to an energy loss of the ion beam and the diffusion of the ion beam. A part of electrons emitted from the neutralizer 34 heads for the anode 31 by the axial direction electric field $E_x$. As a result, a discharge current is easy to generate in the channel due to the movement of electrons. The discharge current causes the down of propulsion efficiency of the thruster.

The inventors of the present invention paid attention to the above problems and studied the plasma accelerating apparatus having high propulsion efficiency.

2. First Embodiment

2.1. Overview (Basic Configuration of Plasma Accelerating Apparatus)

FIG. 4 is a partially cut perspective view schematically showing a basic configuration of a plasma accelerating apparatus 1. The plasma accelerating apparatus 1 obtains propulsion by generating an ion beam by using a propellant G and expelling the ion beam in a downstream direction from the plasma accelerating apparatus 1. Regarding the acceleration of ion, the plasma accelerating apparatus 1 is similar to the examples shown in FIG. 1 to FIG. 3. However, the plasma accelerating apparatus 1 does not need any grid to accelerate the ion beam, and is not always necessary to arrange a magnetic field generator on the downstream side than the expelling port surface. In other words, it is possible to generate the ion beam in a released region (space) which is on the downstream side than the plasma accelerating apparatus 1.

In an example of FIG. 4, the plasma accelerating apparatus 1 includes a cathode 11, an anode 12, a power supply 13, a gas supply port 14 and a first magnetic field generator 15. The cathode 11 supplies electrons to a region REG on the upstream side of the plasma acceleration region REG (called an acceleration channel, too,). The power supply 13 applies a voltage between the cathode 11 and the anode 12. The gas supply port 14 is arranged on the outer circumference side than the cathode 11 (outside in the radial direction) and supplies the propellant. G to the plasma acceleration region REG. The first magnetic field generator 15 generates a fan-shaped magnetic field B on the downstream side than the plasma accelerating apparatus 1.

Compared with the examples shown in FIG. 1 to FIG. 3, in an example of FIG. 4, the cathode 11, the gas supply port 14 and the first magnetic field generator 15 are arranged on the upstream side than the plasma acceleration region REG. Therefore, the cathode 11 as the neutralizer is not provided on the downstream side than the plasma accelerating apparatus 1. Note that the anode 12 faces to the plasma acceleration region REG.

In the Description of the present invention, the plasma acceleration region REG is divided into an upstream side region $REG_{UP}$ and a downstream side region $REG_{DOWN}$ to make the description easy to understand. Details of the plasma acceleration region REG will be described blow.

(Operation Principle of Plasma Accelerating Apparatus)

Referring to FIG. 5 to FIG. 9, the operation principle of the plasma accelerating apparatus 1 will be described. Note that each of FIG. 5 to FIG. 9 is a longitudinal cross-sectional view (the cross section along a plane which is parallel to the X-Y plane) schematically showing the plasma accelerating apparatus 1 shown in FIG. 4.

Figure 5:
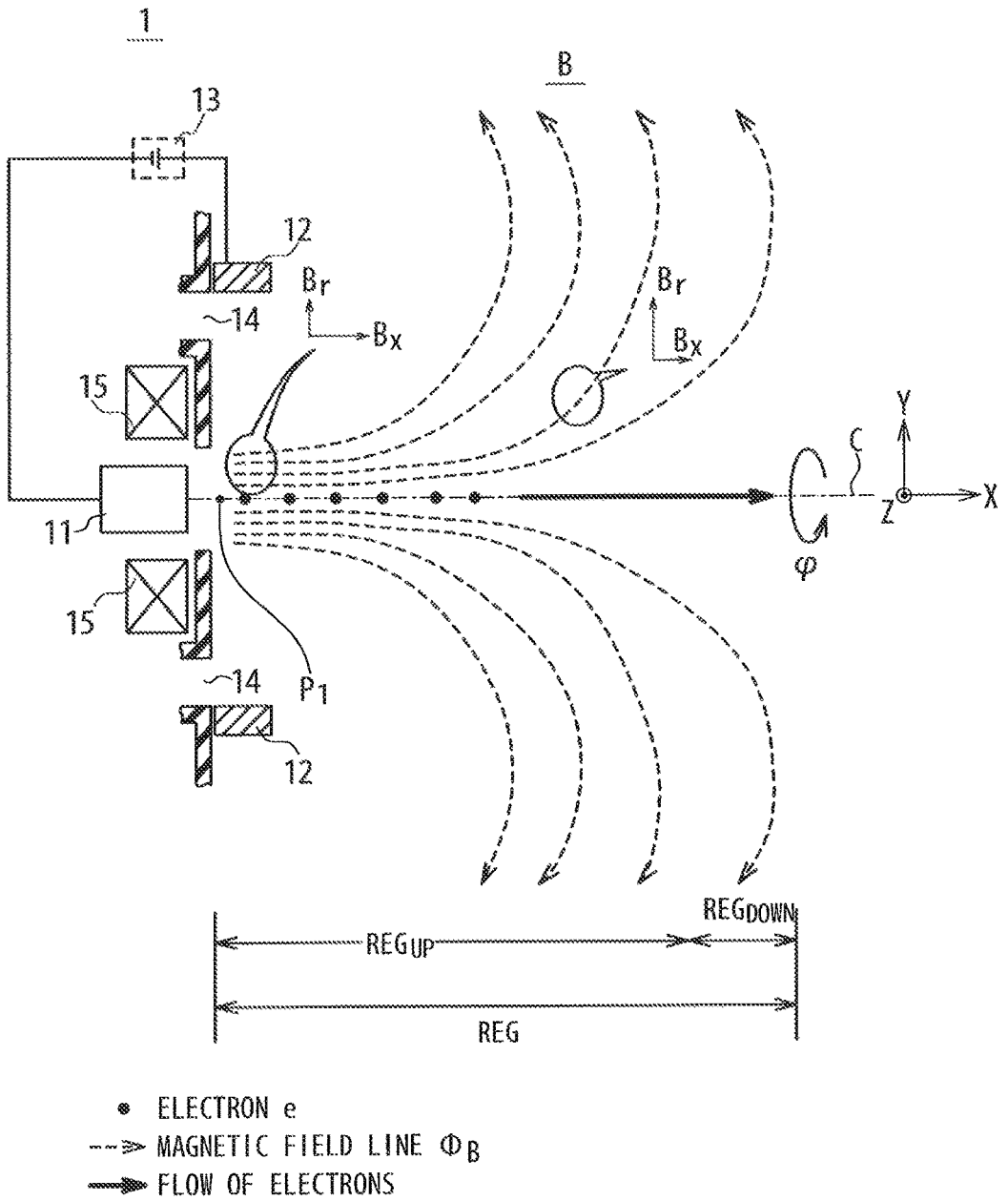
FIG. 5 is a schematic longitudinal cross-sectional view of the plasma accelerating apparatus 1 shown in FIG. 4.

First, the fan-shaped magnetic field generated by the first magnetic field generator 15 will be described briefly. As shown in FIG. 5, as an axial direction magnetic field $B_x$ (an X-axial direction component) decreases monotonously in the upstream side region $REG_{UP}$ as heading for a forward direction from a negative direction on the X axis. On the other hand, a radial direction magnetic field $B_r$ (a radial direction component of the fan-shaped magnetic field) increases monotonously in the upstream side region $REG_{UP}$, as heading for the forward direction from the negative direction on the X axis. In the description of FIG. 5, the fan-shaped magnetic field is a magnetic field in which the magnetic field lines oriented in the axial direction (a center axis direction) spread (diffuse) to the radial direction as the magnetic field lines head for the downstream side. Note that it is possible to assume that the radial direction magnetic field $B_r$ at a point $P_1$ in the neighborhood of the cathode 11 is small to an extent that it can be ignored.

1) As shown in FIG. 5, when electrons (e) are supplied into the fan-shaped magnetic field B from the cathode 11, the electrons move as follows. The electron emitted from the cathode 11 has an axial direction momentum which is larger than the radial direction momentum. Therefore, many electrons move into the downstream direction from the upstream side in the upstream side region $REG_{UP}$. Also, generally, it is difficult for the electron (e) to move across the magnetic field line. Therefore, the movement that the electron heads for the anode 12 is restrained. As a result, power consumption is suppressed and the propulsion efficiency of the plasma accelerating apparatus improves.

One of the reasons why the power consumption is suppressed is in that it is difficult for circulation of the electrons to happen because the movement that the electrons head for the anode 12 is restrained. If the circulation of electrons is caused, the electrons heading for the anode 12 will, do the following conduct.

(a) The electrons heading for the anode 12 finally flows into the anode 12.

(b) The electrons flowed into the anode 12 are emitted from the cathode 11 through an electric path between the anode 12 and the cathode 11.

(c) The electrons emitted from the cathode 11 heads for the anode 12 again.

After that, the above-mentioned (a) to (c) are repeated. The above-mentioned circulation of electrons is possible to become a cause that the Joule heat generates in the electric path between the cathode 11 and the anode 12. The generation of the Joule heat causes the power consumption and causes the down of the propulsion efficiency of the plasma accelerating apparatus.

Figure 6:
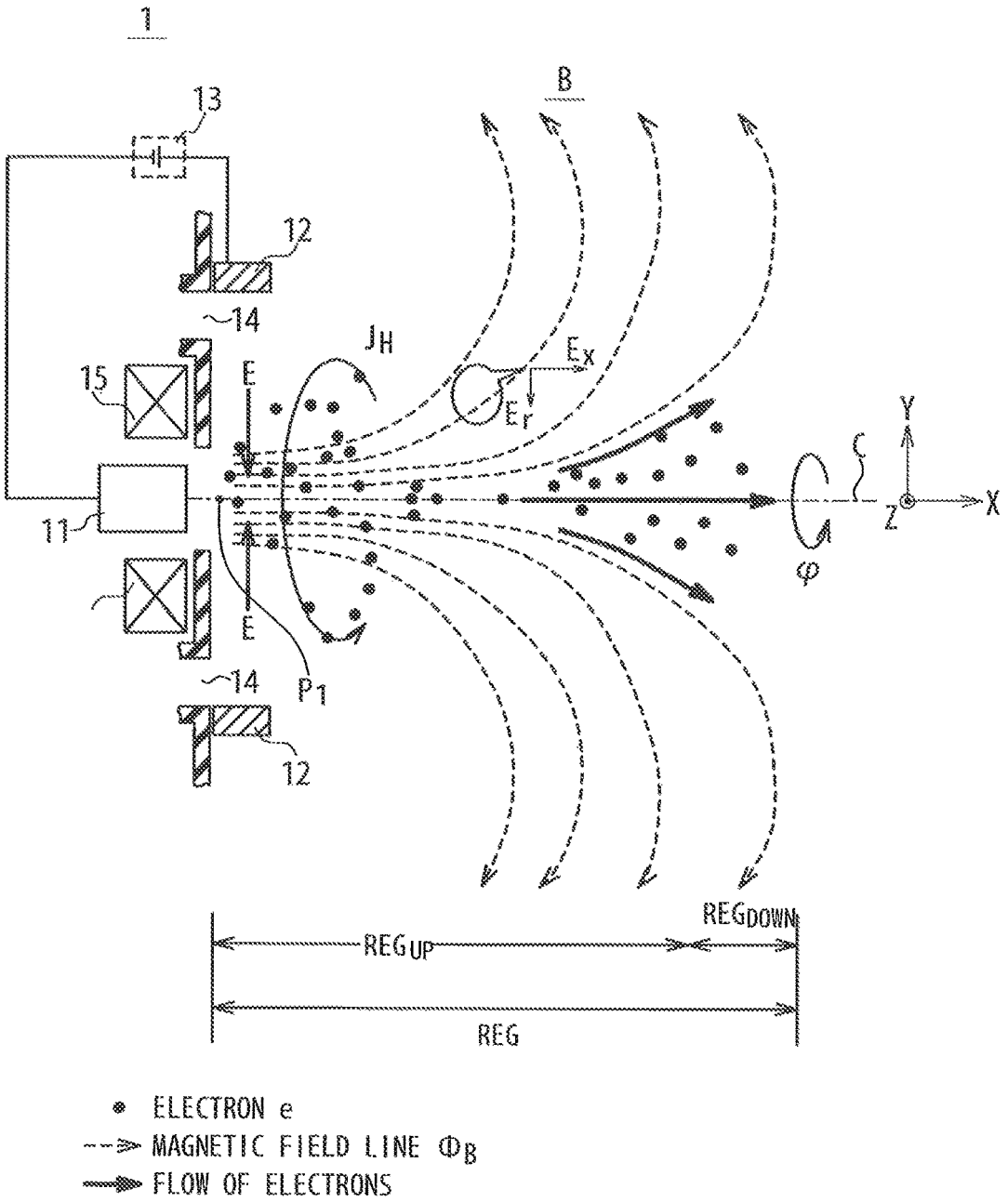
FIG. 6 is a schematic longitudinal cross-sectional view of the plasma accelerating apparatus 1 shown in FIG. 4.

2) As shown in FIG. 6, when a voltage is applied between the cathode 11 and the anode 12, the electric field E is generated in the plasma acceleration region REG. The direction of the electric field E shown in FIG. 6 is a direction heading for the cathode 11 from the anode 12. For example, the direction of the electric field E around a point P1 is a direction heading for the central axis C from the anode 12.

All the electrons emitted from the cathode 11 do not always move in the parallel to the central axis C. A part of the electrons moves to the radial direction across the fan-shaped magnetic field B for the influence of the electric field E. The electrons having moved to the radial direction carry out E×B drift movement and turn around the central axis C. The Hall current $J_H$ is generated around the central axis C (in a $\phi$ direction) for the rotary movement of the electrons. In other words, the Hall current $J_H$ is generated by the interaction of the axial direction magnetic field of the fan-shaped magnetic field B and the electric field E between the cathode 11 and the anode 12.

Figure 7:
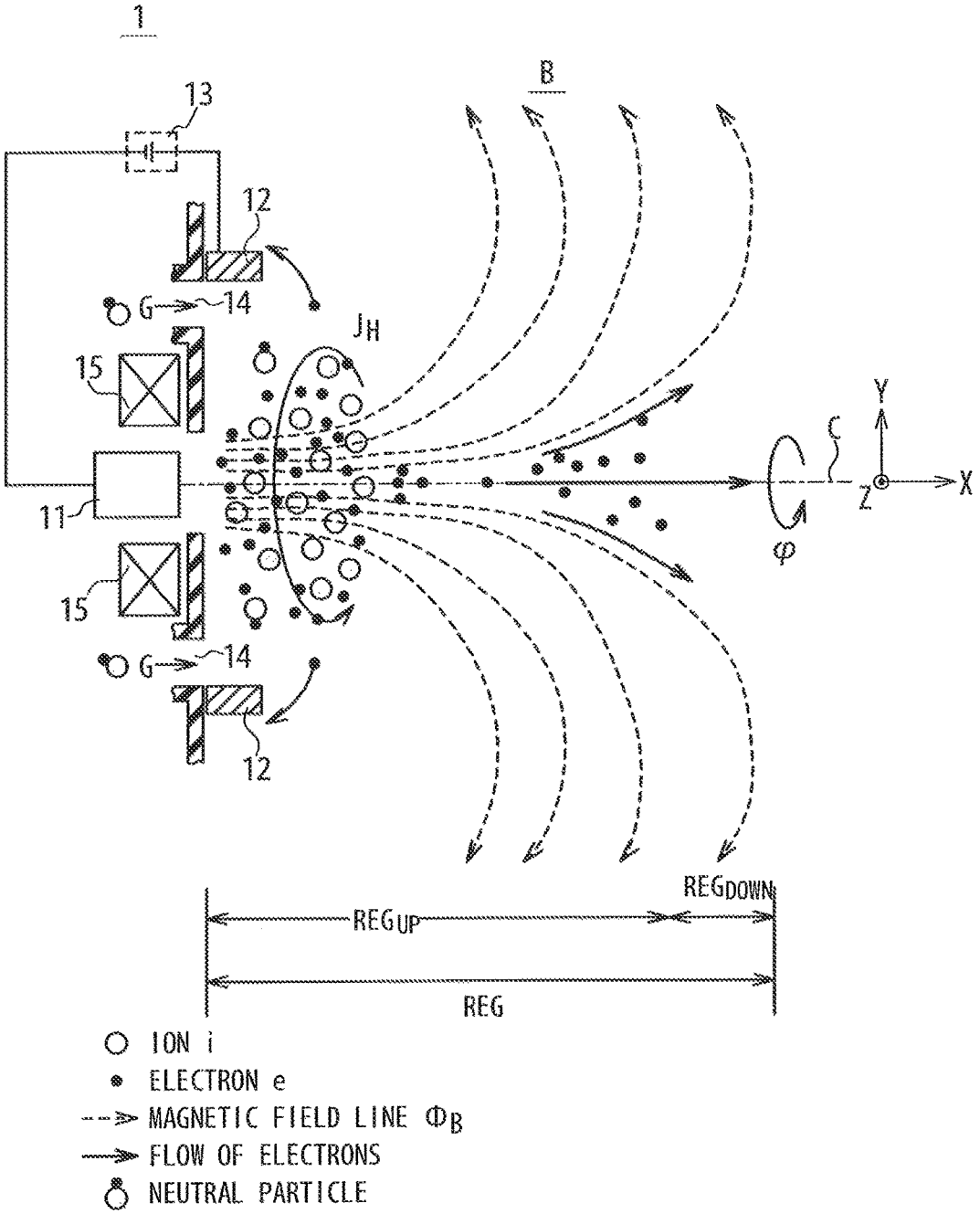
FIG. 7 is a schematic longitudinal cross-sectional view of the plasma accelerating apparatus 1 shown in FIG. 4.

3) As shown in FIG. 7, when the propellant (neuter gas) G is supplied to the plasma acceleration region REG from the gas supply port 14, the following phenomenon happens. The propellant G supplied from the gas supply port 14 collides with the electrons which are a generation source of the Hall current $J_H$. Through the collision, the propellant G is plasmatized. In other words, the propellant is plasmatized by the interaction of the propellant and the Hall current $J_H$. A part of the electrons in the plasma flows into the anode 12. The electrons flowing into the anode 12 flows to the cathode 11 and are emitted from the cathode 11 again.

Figure 8:
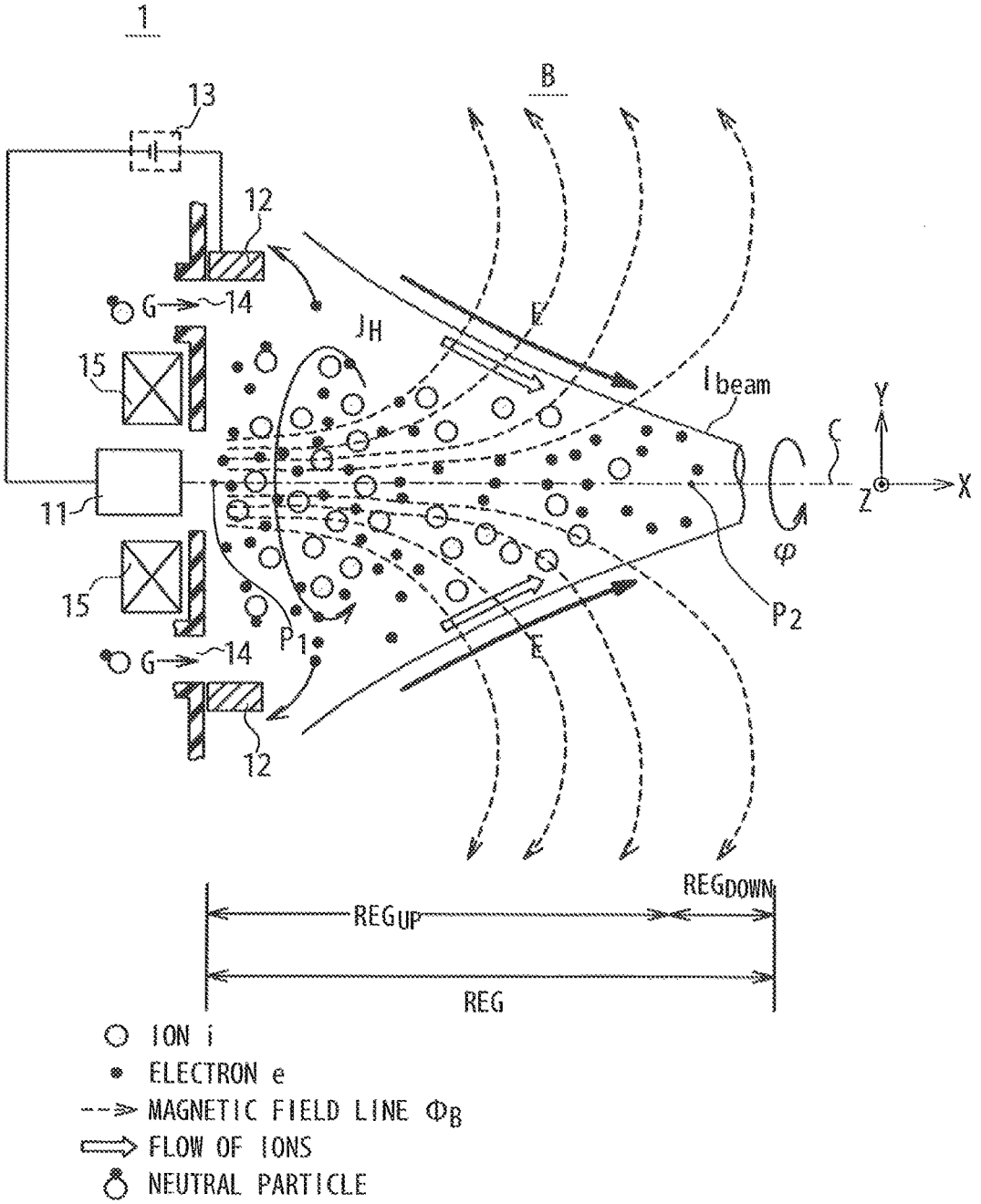
FIG. 8 is a schematic longitudinal cross-sectional view of the plasma accelerating apparatus 1 shown in FIG. 4.

4) As shown in FIG. 8, when the plasmatization of the propellant G progresses, the following phenomenon happens. First, a part of the electrons in the plasma carries out the E×B drift movement and turns around the central axis C. Therefore, the Hall current $J_H$ is strengthened. As a result, the generation of the plasma is more strengthened. Second, the charged particles move helically around the magnetic field lines along the magnetic field line. Therefore, the ions (i) in the plasma have momentum components in directions along the magnetic field line. Third, the potential around some point $P_2$ in the downstream side region $REG_{DOWN}$ falls down due to the existence of electrons in the downstream side region $REG_{DOWN}$. From the above, as shown in FIG. 8, the electric field E is generated in a direction heading for electrons in the downstream side region $REG_{DOWN}$ from the anode 12. As a result, the ions in the plasma are accelerated to the direction of the electric field E. A flow of the ions is the ion beam $I_{beam}$. The ion beam $I_{beam}$ flows into the direction to the downstream side from the upstream side in the plasma acceleration region REG such that the ion beam $I_{beam}$ do not spread to the radial, direction in the downstream side region $REG_{DOWN}$.

Figure 9:
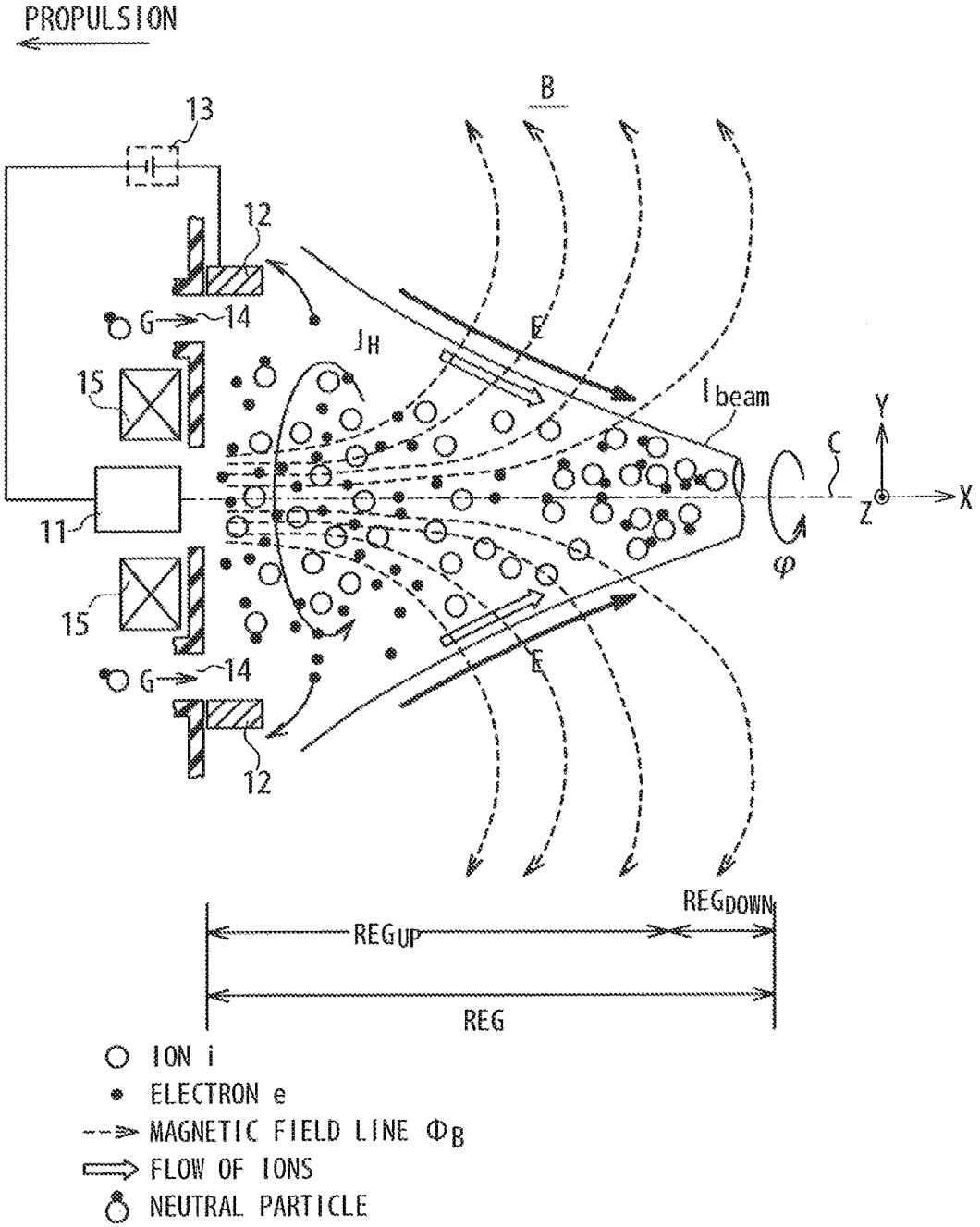
FIG. 9 is a schematic longitudinal cross-sectional view of the plasma accelerating apparatus 1 shown in FIG. 4.

5) As shown in FIG. 9, the ions of the plasmatized propellant are accelerated to the direction of the electric field E. As a result, the ions combine with the electrons in the downstream side region $REG_{DOWN}$. In other words, the ions of the ion beam $I_{beam}$ are neutralized. Note that the ions combined with the electrons are neutral particles. The plasma accelerating apparatus 1 acquires propulsion in a direction opposite to the direction of the ion beam $I_{beam}$.

As described above, since the plasma accelerating apparatus has the configuration shown in FIG. 4, the ion beam is generated in a region (space) on a downstream side than the plasma accelerating apparatus. As a result, the propulsion efficiency of the plasma accelerating apparatus is improved.

The main reason why the propulsion efficiency is improved is as follows. First, the ion beam does not collide with the wall surface or frequency of the collision is few. Therefore, the energy loss of the ion beam is restrained. Especially, when the wall surface surrounding the plasma acceleration region REG (for example, a circularly cylindrical wall) is not provided, the large effect is obtained that the energy loss of the ion beam is restrained.

Second, there is no limitation of the ion beam current by the spatial charge limitation law for the reason of the structure of the plasma accelerating apparatus. In addition to this, there is no limitation of the ion beam current due to a grid width. Therefore, it is easy to increase the ion beam current. Also, because the grid electrode is unnecessary, the wearing-out of the grid is restrained, and the upper limit of the propulsion is not restrained due to the grid area. For this reason, a large size of the plasma accelerating apparatus can be accomplished easily.

Third, the ion beam is difficult to spread to the radial direction. As shown in FIG. 9, the direction of the electric field is a direction heading for the electrons in the downstream side region $REG_{DOWN}$ from the anode 12. Therefore, the ion beam is easy to be focused for the central axis.

2.2. Configuration Example of Plasma Accelerating Apparatus

Figure 10:
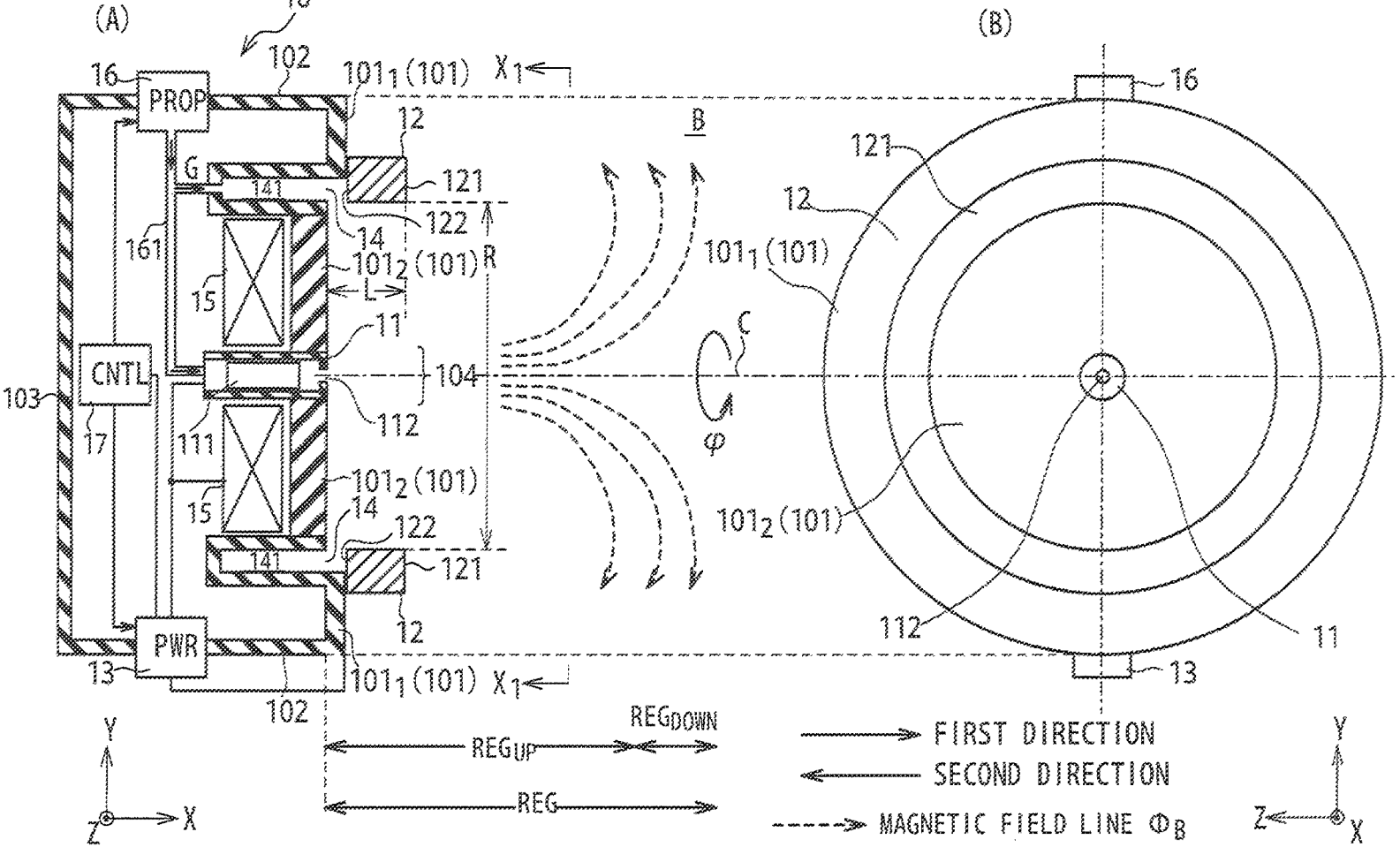
FIG. 10 is a diagram schematically showing a configuration example of the plasma accelerating apparatus 1.

FIG. 10 is a diagram schematically showing a configuration example of the plasma accelerating apparatus 1. Here, a part (A) of FIG. 10 is a longitudinal cross-sectional view schematically showing the plasma accelerating apparatus 1. A part (B) of FIG. 10 is a cross-sectional view along the line $X_1$-$X_1$ shown in the part (A) of FIG. 10 (a back view when viewed from, the forward direction to the negative direction on the X axis).

As shown in FIG. 10, the plasma accelerating apparatus 1 includes a chassis (housing) 10 and a propellant tank 16 in addition to the cathode 11, the anode 12, the power supply 13, the gas supply port 14, and first magnetic field generator 15. The plasma accelerating apparatus 1 may have a controller 17 as shown in FIG. 10.

(Housing)

The housing 10 is formed of an insulating member (e.g. insulative ceramics). In an example of FIG. 10, the shape of the outward appearance of the housing 10 is a circularly cylindrical shape (in this Description, the circularly cylindrical shape contains a shape similar to the circularly cylindrical shape). In detail, the housing 10 has a first wall section 101 in contact with the plasma acceleration region REG, a side wall section 102, a second wall section 103 opposing to the first wall section 101, and an electron emission port 104. The electron emission port 104 is arranged in the first wall section 101 to emit electrons supplied from the cathode 11. In the example of FIG. 10, the electron emission port 104 is an opening provided for the center of the first wall section 101 (specifically, the center of an inner circumference side wall section $\mathbf{101}_2$ to be described later) to provide the cathode 11. Note that in the example of FIG. 10, a part of the power supply 13 is exposed from the housing 10 but the whole power supply 13 may be stored in the housing 10. This is same as in the propellant tank 16.

In the following description, the first wall section 101 is sometimes divided into two wall sections. One is called an outer circumference side wall section $\mathbf{101}_1$ which is a part of the outer circumference side than the gas supply port 14. The other is called an inner circumference side wall section $\mathbf{101}_2$ which is a part between the gas supply port 14 and the electron emission port 104. The inner circumference side wall section $\mathbf{101}_2$ is sometimes merely called an insulation wall. Note that the first wall section 101 is a wall section which has a wall surface perpendicular to the central axis C (in this Description, the word "perpendicular" contains "almost perpendicular"). The outer circumference side wall section $\mathbf{101}_1$ has a wall surface perpendicular to the central axis C. Like the outer circumference side wall section $\mathbf{101}_1$, the inner circumference side wall section $\mathbf{101}_2$ has a wall surface perpendicular to the central axis C. In the example shown in the part (A) of FIG. 10, the downstream side end surface (a surface in contact with the plasma acceleration region REG) of the inner circumference side wall section $\mathbf{101}_2$ is arranged on the upstream side than the downstream side end surface (a surface in contact with the plasma acceleration region REG) of the outer circumference side wall section $\mathbf{101}_1$. Alternatively, the downstream side end surface of the inner circumference side wall section $\mathbf{101}_2$ may coincide with the downstream side end surface of the outer circumference side wall section $\mathbf{101}_1$.

(Cathode)

The cathode 11 has a role of the neutralizer in addition to a role of an electron emitting source. For example, the cathode 11 is a hollow cathode. Alternatively, the cathode 11 may be a filament cathode or an electron source to which high frequency discharge is applied. The cathode 11 is enough to be configured to receive the supply of a voltage (power) from the power supply 13, and to emit electrons from the cathode electrode 111 so as to pass through a hole section 112 and so as to flow into the fan-shaped magnetic field. In the example of FIG. 10, the cathode 11 has a cathode electrode 111 and the hole section 112. The cathode 11 is connected with the power supply 13. Moreover, the cathode 11 is indirectly and electrically connected with the anode 12.

The cathode 11 is arranged as follows. In the example of FIG. 10, the cathode 11 is arranged on the upstream side than the anode 12 (specifically, the downstream side end surface 121 of the anode 12), and is arranged at the center of the inner circumference side wall section $\mathbf{101}_2$ (the electron emission port 104). In detail, the hole section 112 of the cathode 11 is arranged on the upstream side than the downstream side end surface 121 of the anode 12 in the longitudinal section view. Also, the position of the hole section 112 of the cathode 11 along the first direction (the forward direction of the X axis) coincides with the position of the electron emission port 104 along the first direction. The position of a tip part (the hole section 112) of the cathode 11 along the first direction coincides with the position of the inner circumference side wall section $\mathbf{101}_2$ (specifically, the surface of the inner circumference side wall section $\mathbf{101}_2$ in contact with the plasma acceleration region REG) along the first direction. Note that the position of the hole section 112 is not restricted to the example shown in FIG. 10. For example, the hole section 112 of the cathode 11 may be arranged on the upstream side than the gas supply pot 14 in the longitudinal section view. Also, in the example of FIG. 10, the cathode 11 can be said to be arranged on the central axis C.

Note that the above-mentioned cases shown in FIG. 4 to FIG. 9 show a case where the cathode 11 receives the negative voltage from the power supply 13. However, FIG. 4 to FIG. 9 only schematically show that the cathode 11 is the electron supply source.

(Anode)

The anode 12 is formed of an electrical conductor and has a role to generate an electric field in the plasma acceleration region REG. The anode 12 has a downstream side end surface 121 and an upstream side end surface 122. The upstream side end surface 122 is a surface opposite to the downstream side end surface 121. The anode 12 has a ring shape (in this Description, the ring shape contains an almost ring-like shape) in the back view (viewing the negative direction from the forward direction on the X axis). The anode 12 is connected with the power supply 13. Note that the anode 12 may be divided in a constant interval along the circumferential direction of the anode 12.

The anode 12 is arranged as follows. In the example shown in the part (A) of FIG. 10, the anode 12 is provided on the first wall section 101. As mentioned above, because the downstream side end surface of the inner circumference side wall section $\mathbf{101}_2$ is arranged on the upstream side than the downstream side end surface of the outer circumference side wall section $\mathbf{101}_1$, the anode 12 is located on the downstream side than the gas supply port 14. In detail, a part of upstream side end surface 122 is arranged on the outer circumference side wall section $\mathbf{101}_1$ so that a part of propellant emitted from the gas supply port 14 hits to a part of the upstream side end surface 122 of the anode 12. Therefore, in the example shown in the part (A) of FIG. 10, the whole anode 12 is located on the downstream side than the cathode 11.

In the example shown in the part (A) of FIG. 10, the distance L between the first wall section 101 (specifically, the inner circumference side wall section $\mathbf{101}_2$) and the downstream side end surface 121 of the anode 12 is, for example, equal to or less than ⅓ of the inner diameter R of the anode 12 ($L \leq R/3$). Desirably, the distance L is, for example, equal to or less than ⅕ of the inner diameter R of the anode 12 ($L \leq R/5$). Because the distance L is equal to or less than ⅓ of the inner diameter R of the anode 12, the possibility that the plasma collides with the anode 12 is reduced.

Note that the anode 12 may be arranged as follows. In the example of FIG. 10, the anode 12 is arranged to be biased to one of the ends of the outer circumference side wall section. $\mathbf{101}_1$. However, the anode 12 may be arranged at the center of the outer circumference side wall section $\mathbf{101}_1$. In other words, the whole upstream side end surface 122 of the anode 12 may contact the outer circumference side wall section $\mathbf{101}_1$. In this case, the whole anode 12 is arranged on the outer circumference side than the gas supply port 14. In the example of FIG. 10, the anode 12 is arranged directly on the outer circumference side wall section $\mathbf{101}_1$. However, a thin spacer may be arranged between them. Alternatively or additionally, the anode 12 may be arranged on the inner circumference side wall section $\mathbf{101}_2$.

(Power Supply)

The power supply 13 is, for example, a fuel cell. That is, the power supply 13 is a power supply source to the plasma accelerating apparatus 1. The power supply 13 may be configured from a voltage source and/or an electric current source. In the example of FIG. 10, the power supply 13 is configured to supply (apply) a negative voltage to the cathode 11 and to supply a positive voltage to the anode 12. Besides, the power supply 13 may supply power to the controller 17 and may supply a current to the first magnetic field generator 15.

(Gas Supply Port)

The gas supply port 14 is connected with a gas pipe 161 through a gas passage 141. In this case, the gas passage 141 is a passage through which the propellant G supplied from a propellant tank 16 flows, and extends to the upstream side from the gas supply port 14. In the example of FIG. 10, the gas supply port 14 has a ring shape in the back view (viewing for the negative direction from the forward direction on the X axis). Also, in the example shown in the part (A) of FIG. 10, the gas supply port 14 is perpendicular to the central axis C.

The gas supply port 14 is arranged as follows. In the example of FIG. 10, the gas supply port 14 is arranged on the downstream side than the first magnetic field generator 15. The gas supply port 14 is arranged on the outer circumference side than the cathode 11. In the example shown in FIG. 10, the whole gas supply port 14 is covered with the upstream side end surface 122 of the anode 12 in the position of the downstream side end surface of the outer circumference side wall section $\mathbf{101}_1$. Alternatively, a part of the gas supply port 14 may be covered with the upstream side end surface 122 of the anode 12 in the position of the downstream side end surface of the outer circumference side wall section $\mathbf{101}_1$. Note that the arranging of the gas supply port 14 may be expressed as follows. The direction that heads for the downstream side region $REG_{DOWN}$ of the plasma acceleration region REG from the upstream side region $REG_{UP}$ of the plasma acceleration region REG is defined as a first direction. Alternatively, the movement direction of the electron emitted from the cathode 11 may be defined as the first direction. When using the expression of the first direction, the gas supply port 14 is arranged in the first direction from the first magnetic field generator 15.

(Propellant)

The propellant G is a propellant before plasmatization or a propellant after plasmatization. In the following description, it is supposed that the propellant G is the propellant before plasmatization. Regarding a case that the propellant G is the propellant after plasmatization, it will be described later. For example, the propellant G is noble gas. Specifically, the propellant G is, for example, xenon gas. Alternatively, the propellant G may be argon gas or krypton gas. The propellant G is enough to be gas which is easy to be ionized. For example, hydrogen gas is not noble gas but has the nature being easy to be ionized. Therefore, the hydrogen gas may be used as the propellant.

(First Magnetic Field Generator)

For example, the first magnetic field generator 15 is an electromagnetic coil, Alternatively, the first magnetic field generator 15 may be a permanent magnet. When the electromagnetic coil of a ring shape (viewing from the back) is used as the first magnetic field generator 15, the intensity of the magnetic field becomes able to be adjusted by changing the power to be supplied to the electromagnetic coil. Moreover, the turning on/off of the generation of the fan-shaped magnetic field becomes able to be controlled. On the other hand, when a permanent magnet is used as the first magnetic field generator 15, it does not need electric power to generate the fan-shaped magnetic field. In the following description, it is supposed that the first magnetic field generator 15 is an electromagnetic coil, as far as there is not a special attention. In this case, the first magnetic field generator 15 will be described as follows. The first magnetic field generator 15 is formed from a coil. In the example of FIG. 10, the cathode 11 is arranged on the inner circumference side of the first magnetic field generator 15 (the coil). The first magnetic field generator 15 generates the fan-shaped magnetic field B for a period during which the current is supplied from the power supply 13. The fan-shaped magnetic field B will be described later in detail.

The first magnetic field generator 15 is arranged as follows. The first magnetic field generator 15 is arranged on the upstream side than the gas supply port 14. The first magnetic field generator 15 may be expressed as follows. The first magnetic field generator 15 is arranged on the upstream side than the first wall section 101 (specifically, inner circumference side wall section $\mathbf{101}_2$). In other words, when the direction opposite to the first direction is defined as a second direction, the first magnetic field generator 15 is arranged in the second direction from the end of the plasma acceleration region REG in the second direction.

Note that in the example shown in the part (A) of FIG. 10, the first magnetic field generator 15 is arranged inside the housing 10 on the upstream side than the plasma acceleration region REG, and is not arranged to surround the plasma acceleration region REG.

(Propellant Tank)

The propellant tank 16 is a tank which accommodates the propellant G. The propellant tank 16 is connected with the gas pipe 161. The gas pipe 161 is connected with the gas passage 141. For example, a valve (not shown) is connected with the propellant tank 16. By the valve being driven, the propellant G is supplied to the gas pipe 161.

(Controller)

For example, the controller 17 is configured from a microcomputer and a memory. The controller 17 has a role to control the operation of the whole plasma accelerating apparatus 1. In the example of FIG. 10, the control target of the controller 17 is roughly divided into two. The first is a control of the power supply 13. The controller 17 controls timing at (a period for) which a voltage is applied between the cathode 11 and the anode 12 by controlling the turning on/off of the power supply 13 (the voltage source). Moreover, the controller 17 controls the timing at which the current is supplied to the first magnetic field generator 15 by controlling the turning on/off of the power supply 13 (the current source). Second, the controller 17 controls the valve of the propellant tank 16. The controller 17 controls the valve of the propellant tank 16 for a generation period of the ion beam to supply the propellant G to the gas pipe 161. Note that the controller 17 may be provided outside the plasma accelerating apparatus 1 (for example, the fuselage of the spacecraft).

2.3. Fan-Shaped Magnetic Field

Figure 11:
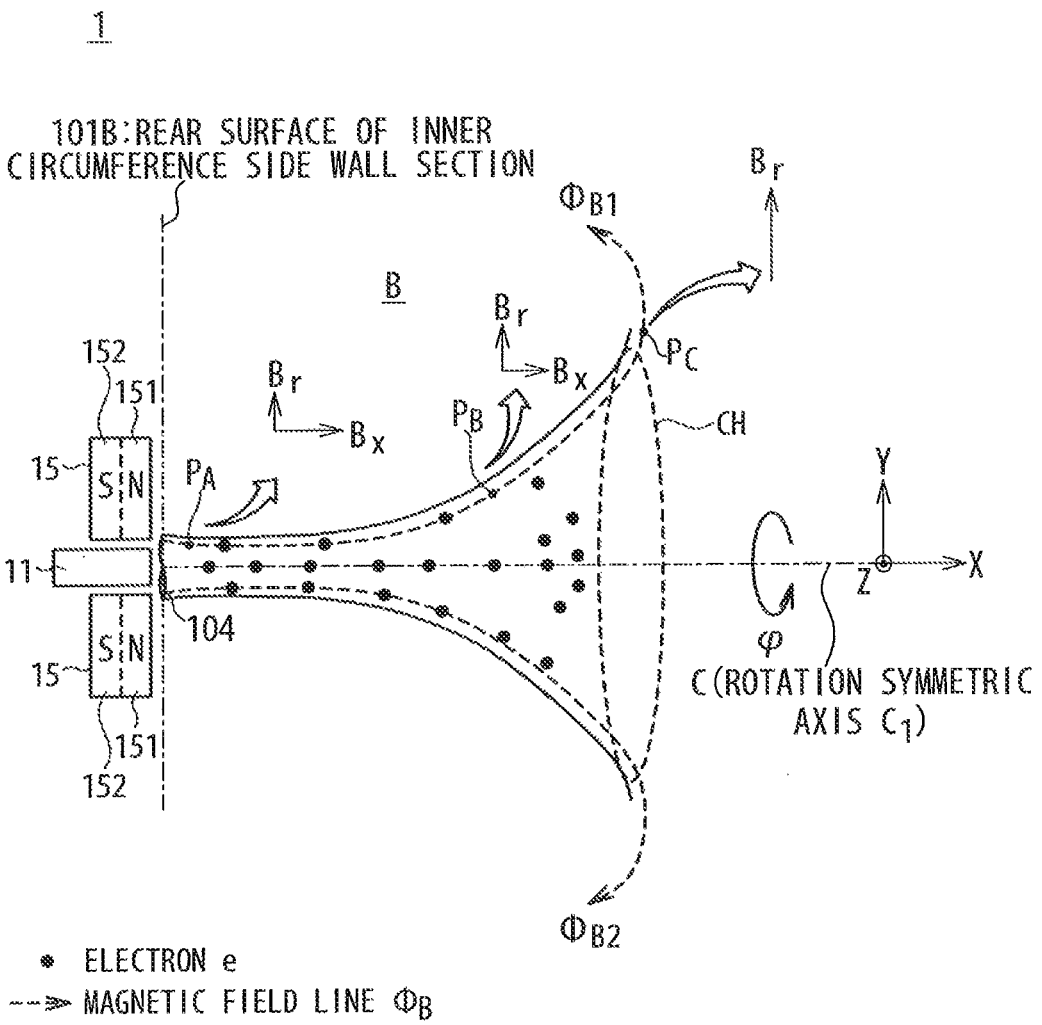
FIG. 11 is a diagram showing a fan-shaped magnetic field.

The fan-shaped magnetic field will be described below, FIG. 11 is a diagram to explain the fan-shaped magnetic field. To make it easy to understand the description, it is supposed that one of the ends of the first magnetic field generator 15 is an N pole $\mathbf{15}_1$ and the other end is an S pole $\mathbf{15}_2$. In an example of FIG. 11, the current is supplied to the first magnetic field generator 15 such that the downstream side end surface 101B of the inner circumference side wall section $\mathbf{101}_2$ (merely, referred to as a rear surface 101B of the first wall section) become the N pole $15_1$. As well known, the magnetic field lines of the fan-shaped magnetic field generated by the first magnetic field generator 15 exit from the N pole $15_1$ and return to the S pole $15_2$ while drawing a loop.

In the example of FIG. 11, the fan-shaped magnetic field B has a rotation symmetry with respect to the central axis C (X axis). Moreover, in the example of FIG. 11, the rotation symmetry axis $C_1$ of the fan-shaped magnetic field B coincides with the central axis C. The component of the fan-shaped magnetic field B is divided into two components. One is an axial component ($B_x$). The axial component is a component which is parallel to the central axis C and is called an axial direction magnetic field $B_x$ (a first axial direction magnetic field). The other is a component ($B_r$) in a radial component. The radial component is a component perpendicular to the central axis C and is called radial direction magnetic field $B_r$ (a first radial direction magnetic field).

To explain the shape of magnetic field line $\Phi_{B1}$, three points are set on the magnetic field line $\Phi_{B1}$. The first point $P_A$ is in the neighborhood of the rear surface 101B of the first wall section. In the first point $P_A$, the axial direction magnetic field $B_x$ is very larger than the radial direction magnetic field $B_r$. Note that in the point $P_A$, the radial direction magnetic field $B_r$ may be ignored. In this case, it may be assumed that only the axial direction magnetic field exists. The second point $P_B$ is on the downstream side than the first point $P_A$. In the second point $P_B$, the axial direction magnetic field $B_x$ is smaller than the axial direction magnetic field B in the first point $P_A$. The radial direction magnetic field $B_r$ is larger than the radial direction magnetic field $B_r$ in the first point $P_A$. The third point $P_c$ is an inflection point of magnetic field line $\Phi_{B1}$. In the third point $P_c$, the axial direction magnetic field $B_x$ is zero. The radial direction magnetic field $B_r$ is larger than the radial direction magnetic field $B_r$ in the second point $P_B$.

By summarizing the above, the fan-shaped magnetic field may be expressed as follows. As shown in FIG. 11, the fan-shaped magnetic field B is an axis rotation symmetry magnetic field. On the downstream side than the rear surface 101B of the first wall section, the fan-shaped magnetic field B has the inflection point. The axial direction magnetic field $B_x$ decreases monotonously and takes zero of the minimum value in the inflection point. On the other hand, the radial direction magnetic field. $B_r$ increases monotonously until the axial direction magnetic field $B_x$ takes zero in the inflection point.

(Flow Path of Electrons)

Using the words of the flow path of electrons, the first magnetic field generator can be expressed. Referring to FIG. 11, the flow path of electrons will be described. To make the description simple, it is supposed that there are two magnetic field lines in the neighborhood of the rotation symmetry axis $C_1$ on the X-Y plane as shown in FIG. 11. One of the two magnetic field lines is the above-mentioned magnetic field line $\Phi_{B1}$. On the other hand, the other is a magnetic field line $\Phi_{B2}$ symmetrical to the magnetic field line $\Phi_{B1}$ with respect to the rotation symmetry axis $C_1$. As shown in FIG. 11, most of the electrons emitted from the cathode 11 pass through a region CH surrounded by the magnetic field line $\Phi_{B1}$ and the magnetic field line $\Phi_{B2}$. This region CH is called the flow path of electrons.

If the words of the flow path of electrons are used, the first magnetic field generator 15 is expressed as follows. The first magnetic field generator 15 forms the flow path of electrons formed by the fan-shaped magnetic field B in the plasma acceleration region. The flow path of electrons extends to the downstream direction of the plasma acceleration region from the electron emission port 104.

(Plasma Acceleration Region)

It has been described that the plasma acceleration region REG is divided into the upstream side region $REG_{UP}$ and the downstream side region $REG_{DOWN}$. In the examples shown in FIG. 4 to FIG. 11, the length of the upstream side region $REG_{UP}$ (in the X axial direction) is a length of the flow path of electrons (for example, equal to or more than 30 cm and equal to or less than 100 cm in the X axial direction). However, the distinction of the upstream side region $REG_{UP}$ and the downstream side region $REG_{DOWN}$ is only to make it easy to understand the description. Note that the axial direction magnetic field $B_x$ may be defined as a region which is larger in the plasma acceleration region REG than the radial direction magnetic field $B_r$. The downstream side region $REG_{DOWN}$ may be defined as a region which is smaller than the radial direction magnetic field $B_r$ in the plasma acceleration region REG.

2.4. Plasma Accelerating Method

Figure 12:
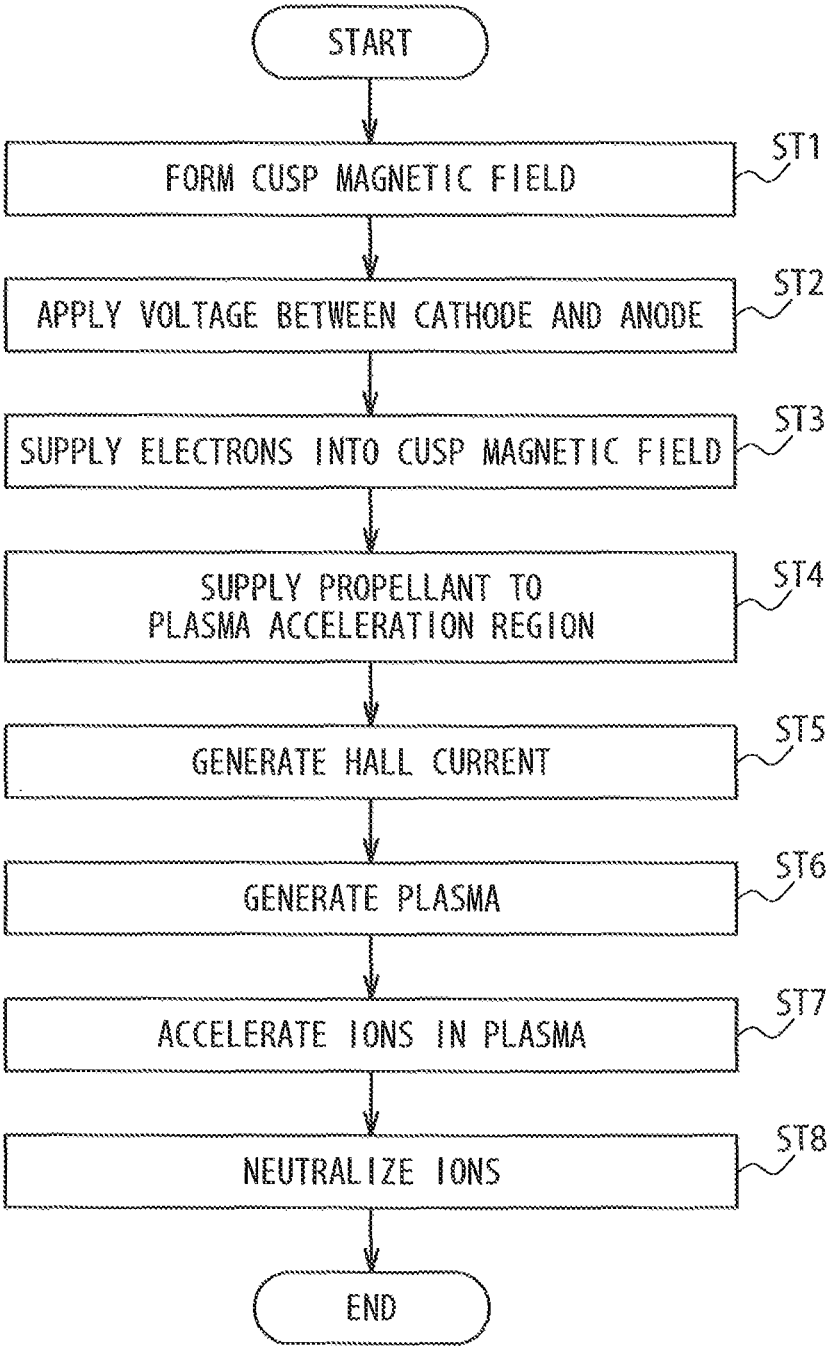
FIG. 12 is a flow chart showing an example of a plasma accelerating method.

The plasma accelerating method using a plasma accelerator will be described. FIG. 12 is a flow chart showing an example of the plasma accelerating method. In an example of FIG. 12, the plasma accelerating method is composed of steps ST1 to ST8. In the following description, FIG. 4 should be referred to, for example.

1) Step ST1:

The first magnetic field generator 15 generates the fan-shaped magnetic field B in the plasma acceleration region REG.

2) Step ST2:

A voltage is applied between the cathode 11 and the anode by the power supply 13.

3) Step ST3:

The electrons emitted from the cathode 11 are supplied into the fan-shaped magnetic field B.

4) Step ST4

The propellant G is supplied to the plasma acceleration region REG from the gas supply port 14.

5) Step ST5:

The Hall current is generated through the interaction of the fan-shaped magnetic field B and the electric field generated between the cathode and the anode.

6) Step ST6:

The plasma is generated in the plasma acceleration region REG through collision the propellant G supplied to the plasma acceleration region REG and the electrons of the Hall current.

7) Step ST7:

Ions in the plasma that is generated in the plasma acceleration region REG are accelerated by using the electric field which is formed by the anode 12 and the electrons in the fan-shaped magnetic field B.

8) Step ST8:

The ions are neutralized through the collision the accelerated ions and the electrons in the fan-shaped magnetic field B.

In the above-mentioned description, a case that the propellant is the propellant before plasmatization has been described. When the propellant is the propellant after plasmatization, the step ST5 and the step ST6 are not necessary to be executed. When the propellant is the propellant after plasmatization, the propellant after plasmatization is supplied to the plasma acceleration region from the gas supply port. In this case, for example, a known plasma generator may be provided on the upstream side than the plasma accelerating apparatus, and the plasma generated by the plasma generator may be supplied to the plasma acceleration region from the gas supply port.

In the above-mentioned description, the magnetic field line outputted from the magnetic field generator returns to the magnetic field generator through the plasma acceleration region. In other words, the fan-shaped magnetic field in the plasma acceleration region has an axial component in the forward direction on the X axis. The direction of the fan-shaped magnetic field may be opposite. In other words, the fan-shaped magnetic field in the plasma acceleration region may have an axial component in the negative direction on the X axis.

According to the first embodiment, the grid electrode is unnecessary and the wearing-out of the grid electrode can be suppressed. Also, according to the first embodiment, the fan-shaped nozzle section becomes able to be omitted. Moreover, an ion beam is difficult to be spread to the radial direction. Therefore, the energy loss of the ion beam is restrained and the propulsion efficiency of the plasma accelerating apparatus is improved.

3. Second Embodiment

3.1. Overview

A second embodiment is related to a method of changing the direction of propulsion in the plasma accelerating apparatus. Two methods of changing the direction of propulsion will be described below.

A first method is a method of changing the orientation of magnetic field generator according to a desired direction of propulsion. If the orientation of magnetic field generator is changed, the generation position of the fan-shaped magnetic field changes according to the orientation of magnetic field generator. If the generation position of the fan-shaped magnetic field changes, the direction of propulsion is changed according to the generation position of the fan-shaped magnetic field.

A second method is a method of using a plurality of magnetic field generators to change the generation position of the fan-shaped magnetic field. Regarding the point that the generation position of the fan-shaped magnetic field is changed, the second method is the same as the first method. In case of the second method, a corresponding generation position of the fan-shaped magnetic field is assigned to each of the plurality of magnetic field generators. The plurality of magnetic field generators are in the different positions respectively but the position of each magnetic field generator is fixed.

(First Method)

Figure 13:
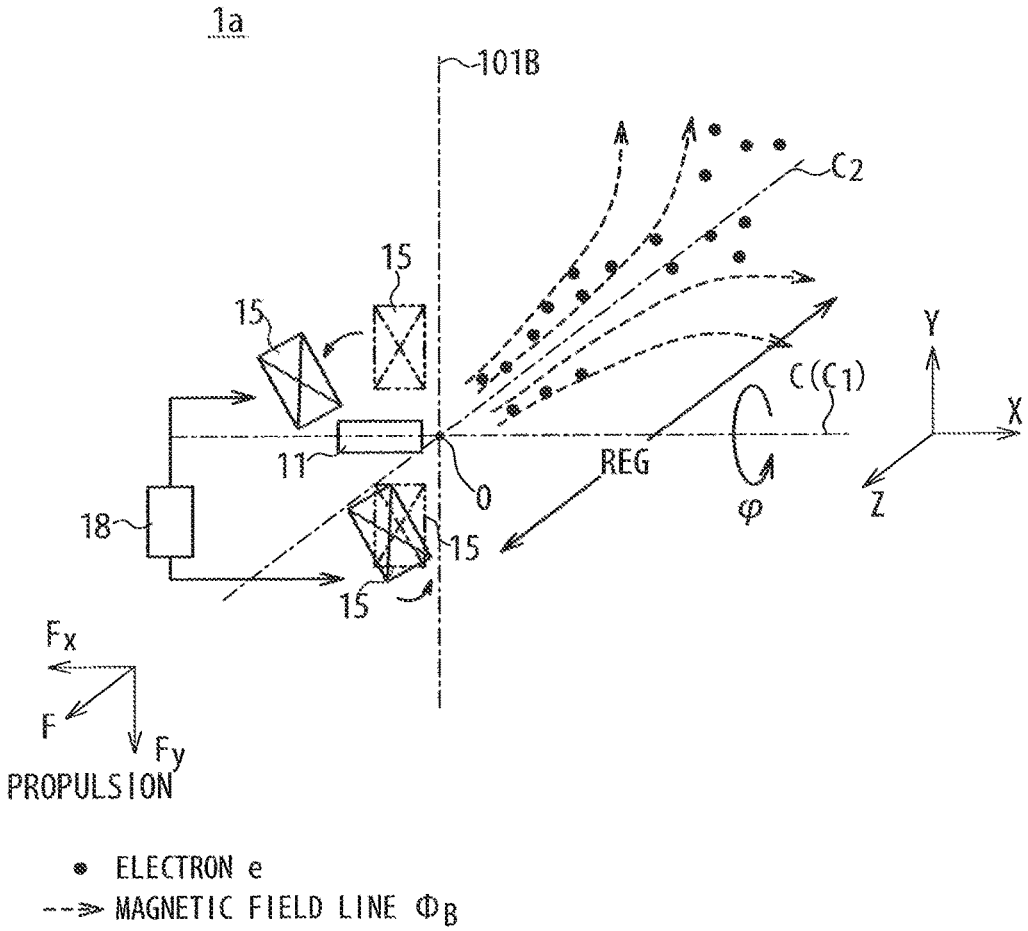
FIG. 13 is a diagram schematically showing a first method of changing a direction of thrust.

The first method will be described. FIG. 13 is a diagram schematically showing the first method of changing the direction of propulsion. For example, as shown in FIG. 13, there is a case that the propulsion F in a diagonal direction to the X axis is desired. In the example of FIG. 13, the propulsion F has a negative X axial component $F_x$ and a negative Y axial component $F_y$. For example, the magnitude of X axial component $F_x$ is the same as the magnitude of negative Y axial component $F_y$. When the propulsion F shown in FIG. 13 is desired, the fan-shaped magnetic field B should be formed in the direction opposite to propulsion F. In other words, it is enough to set the rotation symmetry axis of the fan-shaped magnetic field to obtain the desired propulsion F.

The rotation symmetry axis $C_2$ shown in FIG. 13 is the rotation symmetry axis set newly. In the example of FIG. 13, the rotation symmetry axis $C_2$ is rotated by 45 degrees around the origin O from the initial rotation symmetry axis $C_1$ (a direction of the Y axis from the X axis). For example, the origin O is a point of intersection of the central axis C and the rear surface 101B of the first wall section. Therefore, the fan-shaped magnetic field B generated by the first magnetic field generator 15 is rotated by 45 degrees around the origin O. In the first method, the orientation of the first magnetic field generator 15 is changed so that the fan-shaped magnetic field B having the rotation symmetry axis $C_2$ is generated.

In the example of FIG. 13, the plasma accelerating apparatus 1*a* further includes an orientation changing mechanism 18 in addition to the components of the plasma accelerating apparatus 1 in the first embodiment. The orientation changing mechanism 18 is configured from, for example, a motor and plural types of gears, to make it possible to change the orientation of first magnetic field generator 15. The orientation changing mechanism 18 changes an angle of the first magnetic field generator 15 to generate the fan-shaped magnetic field B having the rotation symmetry axis $C_2$. In the example of FIG. 13, the orientation changing mechanism 18 rotates the first magnetic field generator 15 by 45 degrees (to the negative direction of the Y axis from the forward direction of the X axis) from the initial position (referring to two chain lines).

By changing the orientation of first magnetic field generator 15 by the orientation changing mechanism 18, the fan-shaped magnetic field B generated by the first magnetic field generator 15 is rotated around the origin O by 45 degrees. As described with reference to FIG. 11, the fan-shaped magnetic field B shown in FIG. 13 is dissolved into the axial direction magnetic field B (the second axial direction magnetic field) and the radial direction magnetic field $B_r$ (the second radial direction magnetic field). Also, with the change of the orientation of the first magnetic field generator 15, the plasma acceleration region REG is rotated around the origin O by 45 degrees.

The electrons emitted from the cathode 11 are supplied to the fan-shaped magnetic field B shown in FIG. 13. As a result, there is no change in the generation of the ion beam in the plasma acceleration region REG. Note that the angle of the cathode 11 may be changed together with the first magnetic field generator 15. That is, the orientation changing mechanism 18 may change both of the orientation of the cathode 11 and the orientation of the first magnetic field generator 15.

(Second Method)

The second method will be described. In the above-mentioned first method, the orientation of magnetic field generator is changed according to a desired direction of propulsion. Therefore, the structure of the plasma accelerating apparatus may undergo a restriction. In such a case, the second method is effective.

Figure 14:
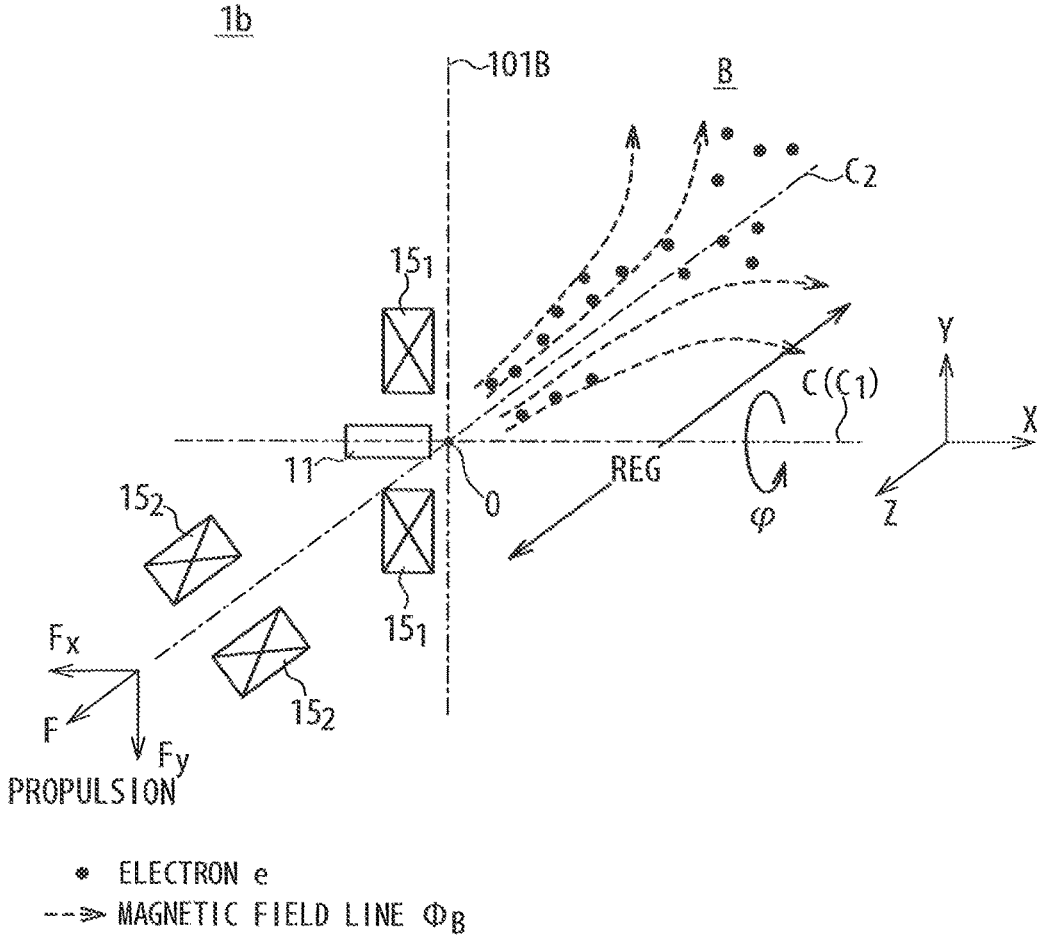
FIG. 14 is a diagram schematically showing a second method of changing a direction of thrust.

FIG. 14 is a diagram schematically showing the second method of changing the direction of propulsion. In an example of FIG. 14, the plasma accelerating apparatus 1*b* further includes a second magnetic field generator $\mathbf{15}_2$ in addition to the first magnetic field generator $\mathbf{15}_1$. The second magnetic field generator $\mathbf{15}_2$ is arranged on the upstream side than the first magnetic field generator $\mathbf{15}_1$ to generate the fan-shaped magnetic field B shown in FIG. 14. However, the position of the first magnetic field generator $\mathbf{15}_1$ and the position of second magnetic field generator $\mathbf{15}_2$ are both fixed. For example, when the fan-shaped magnetic field B shown in FIG. 14 is desired, the supply of the current to the first magnetic field generator $\mathbf{15}_1$ is stopped and the current is supplied to the second magnetic field generator $\mathbf{15}_2$. As a result, the fan-shaped magnetic field B shown in FIG. 14 is obtained. The orientation of the second axial direction magnetic field generated by the second magnetic field generator $\mathbf{15}_2$ is different from the direction of the first axial direction magnetic field generated by the first magnetic field generator $\mathbf{15}_1$. Alternatively, the current may be supplied to both of the first magnetic field generator $\mathbf{15}_1$ and second magnetic field generator $\mathbf{15}_2$.

3.2. Plasma Accelerating Apparatus Applied with Second Method

Figure 15:
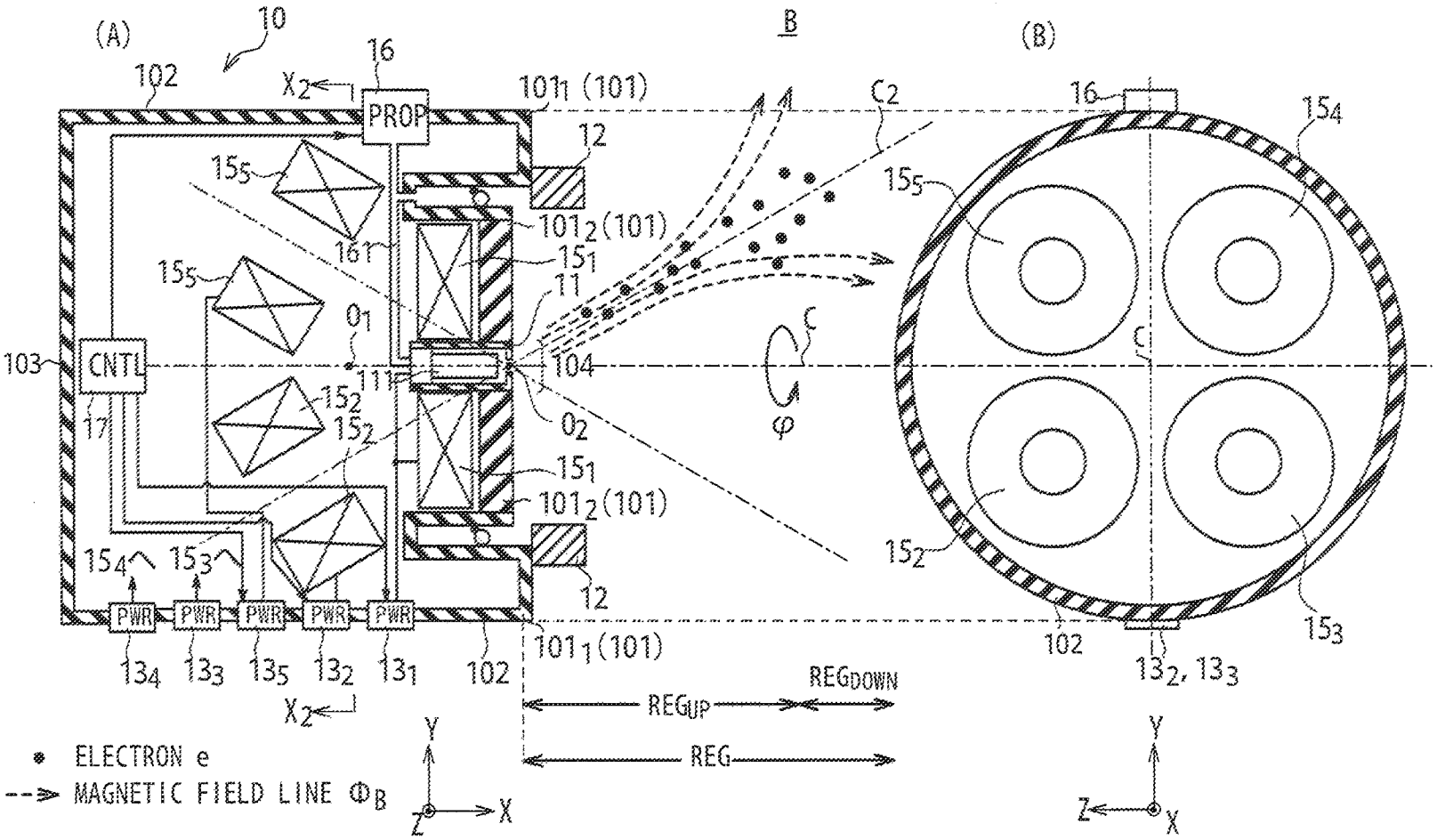
FIG. 15 is a diagram schematically showing a configuration example of a plasma accelerating apparatus 1*b*.

A configuration example of the plasma accelerating apparatus applied with second method will be described below. FIG. 15 is a diagram schematically showing the configuration example of the plasma accelerating apparatus 1*b*. Here, a part (A) of FIG. 15 is a longitudinal cross-sectional view schematically showing the plasma accelerating apparatus 1*b*. A part (B) of FIG. 15 is a cross-sectional view along the line $X_2$-$X_2$ shown in the part (A) of FIG. 15.

The plasma accelerating apparatus 1*b* shown in FIG. 15 has the same components as the components shown in FIG. 10. However, the plasma accelerating apparatus 1*b* differs from the plasma accelerating apparatus 1 shown in FIG. 10 in the following points. The first point is in that a plurality of magnetic field generators are provided. The second point is in that the power supply is provided for each of the plurality of magnetic field generators. It will be described below in order.

(Magnetic Field Generator)

In an example of FIG. 15, the plasma accelerating apparatus 1*b* contains a third magnetic field generator $\mathbf{15}_3$, a fourth magnetic field generator $\mathbf{15}_4$ and a fifth magnetic field generator $\mathbf{15}_5$ in addition to the first magnetic field generator $\mathbf{15}_1$ and second magnetic field generator $\mathbf{15}_2$. The configuration of each of the first to fifth magnetic field generators $\mathbf{15}_1$ to $\mathbf{15}_5$ may be the same as the configuration of the first magnetic field generator 15 shown in FIG. 10. Note that the second to fifth magnetic field generators $\mathbf{15}_2$ to $\mathbf{15}_5$ may be regarded as one magnetic field generator (the second magnetic field generator).

As shown in the part (A) of FIG. 15, the position of the first magnetic field generator $\mathbf{15}_1$ is the same as the position of the first magnetic field generator 15 shown in FIG. 10. The arrangement of each of the second to fifth magnetic field generators $\mathbf{15}_2$ to $\mathbf{15}_5$ is as follows. As shown in the part (A) of FIG. 15, the second to fifth magnetic field generators $\mathbf{15}_2$ to $\mathbf{15}_5$ are respectively arranged on the upstream side than the first magnetic field generator $\mathbf{15}_1$. As shown in the part (B) of FIG. 15, when viewing the plasma accelerating apparatus 1*b* to the negative direction from the forward direction on the X axis, the second to fifth magnetic field generators $\mathbf{15}_2$ to $\mathbf{15}_5$ are arranged in an equal interval in the circumferential direction (the $\phi$ direction). This could be said as follows. When viewing the plasma accelerating apparatus 1*a* to the negative direction from the forward direction on the X axis, an internal region of the housing 10 is divided into four regions in the circumferential direction (the $\phi$ direction). The second to fifth magnetic field generators $\mathbf{15}_2$ to $\mathbf{15}_5$ are arranged in the four regions such that one magnetic field generator is arranged in a corresponding one region.

FIG. 15 shows a case where the second magnetic field generator $\mathbf{15}_2$ is in an operation state. In this case, the magnetic field generators stop the operation other than the magnetic field generator in the operation state. For example, both of the second magnetic field generator $\mathbf{15}_2$ and the third magnetic field generator $\mathbf{15}_3$ may operate according to a desired direction of propulsion. Alternatively, the first magnetic field generator $\mathbf{15}_1$ and at least one of the second to fifth magnetic field generators $\mathbf{15}_2$ to $\mathbf{15}_5$ may be in the operation state.

(Power Supply)

In the example of FIG. 15, the plasma accelerating apparatus 1*b* includes a first power supply $\mathbf{13}_1$, a second power supply $\mathbf{13}_2$, a third power supply $\mathbf{13}_3$, a fourth power supply $\mathbf{13}_4$ and a fifth power supply $\mathbf{13}_5$. The first to fifth power supplies $\mathbf{13}_1$ to $\mathbf{13}_5$ supply current to the first to fifth magnetic field generators $\mathbf{15}_1$ to $\mathbf{15}_5$ respectively. For example, when the second magnetic field generator $\mathbf{15}_2$ is in the operation state, the second power supply $\mathbf{13}_2$ supplies the current to the second magnetic field generator $\mathbf{15}_2$. At this time, the power supplies other than the power supply in the operation state stop the supply of the current.

For example, when the second magnetic field generator $\mathbf{15}_2$ is in the operation state, the plasma accelerating apparatus 1*b* operates as follows. The controller 17 issues an instruction to start the supply of the current to the second power supply $\mathbf{13}_2$ The second power supply $\mathbf{13}_2$ receives the instruction from the controller 17 and supplies the current to the second magnetic field generator $\mathbf{15}_2$. As a result, the fan-shaped magnetic field B shown in FIG. 15 is generated by the second magnetic field generator $\mathbf{15}_2$.

Note that the plasma accelerating apparatus 1*b* may be configured as follows. For example, the number of power supplies may be one. In this case, a switch is provided newly. One power supply (e.g. $\mathbf{15}_1$) is electrically connected with each of the first to fifth magnetic field generators $\mathbf{15}_1$ to $\mathbf{15}_5$. Therefore, in this case, there are five electric paths (for example, one is an electric path between the power supply and the first magnetic field generator $\mathbf{15}_1$). The switch receives the instruction from the controller 17 and selects the electric path(s) from the five electric paths. For example, when the magnetic field generator in the operation state is the second magnetic field generator $\mathbf{15}_2$, the switch selects an electric path between the power supply and the second magnetic field generator $\mathbf{15}_2$.

The number of magnetic field generators except for the first magnetic field generator $\mathbf{15}_1$ may be three, six, or eighty. Like the case of FIG. 15, three, six or eight magnetic field generators are arranged in an equal interval in the circumferential direction. The direction of propulsion can be precisely controlled.

According to the second embodiment, the following effect can be accomplished in addition to the same effect as the effect of the first embodiment. The direction of propulsion of the plasma accelerating apparatus can be changed by the first method of changing the orientation of magnetic field generator or the second method of using a plurality of magnetic field generators. Especially, when the plasma accelerating apparatus is applied to a spacecraft, a gimbal mechanism is unnecessary to change the direction of propulsion.

4. Third Embodiment

Figure 16:
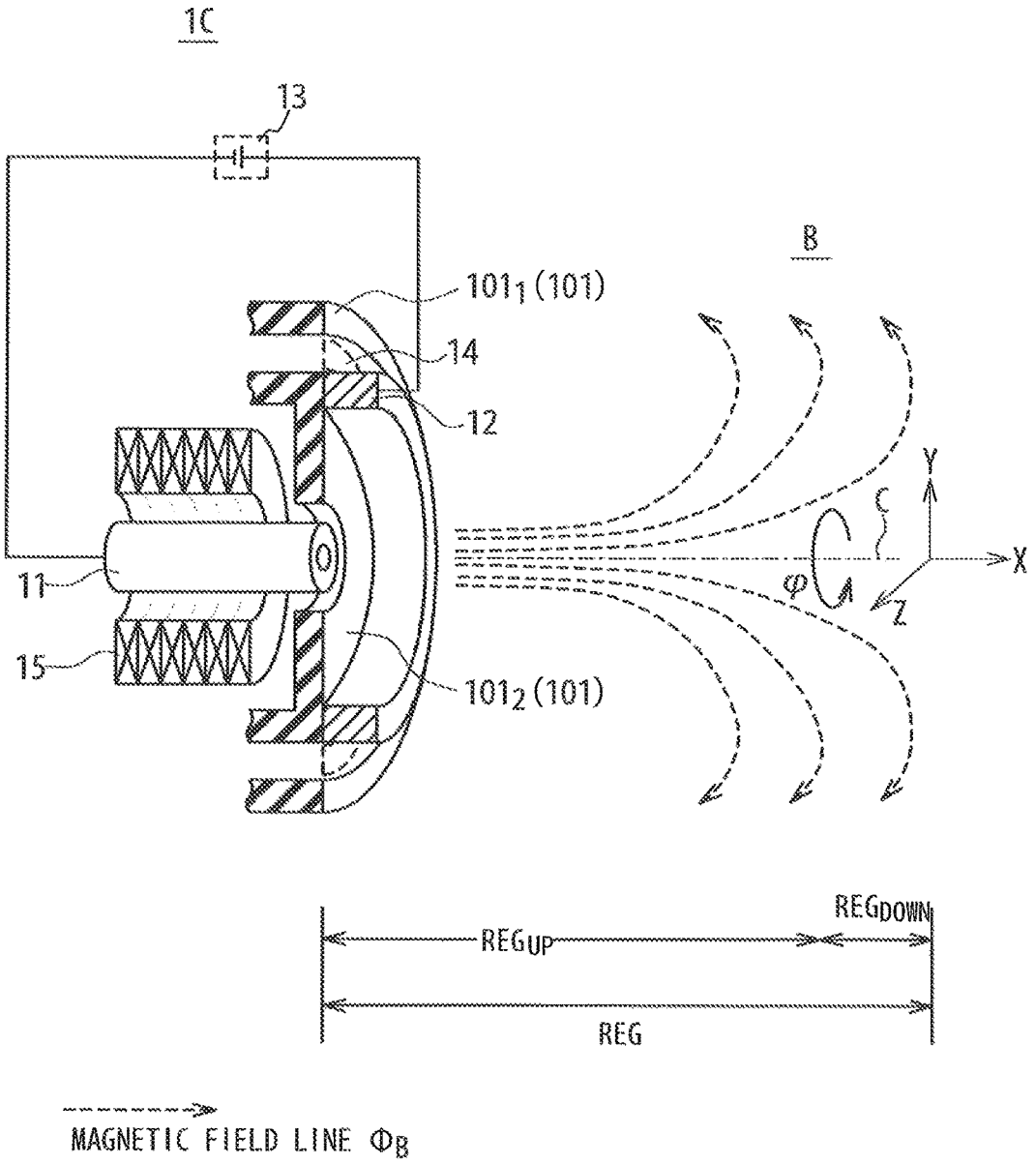
FIG. 16 is a partially cut perspective view schematically showing a configuration example of a plasma accelerating apparatus 1*c*.

The third embodiment is related to the arrangement of the anode. In the above-mentioned first embodiment, the anode is arranged on the outer circumference side wall section. The anode may be arranged as follows. FIG. 16 is a partially cut perspective view schematically showing a configuration example of the plasma accelerating apparatus 1*c*. In the example of FIG. 16, the anode 12 is arranged or the outer circumference side wall section $\mathbf{101}_2$. In other words, the anode 12 is arranged on the outer circumference side than the cathode 11 and on the inner circumference side than the gas supply port 14.

The third embodiment attains the following effect in addition to the same effect as the effect the first embodiment or the second embodiment. Comparing with the first embodiment, the diameter of the anode 12 shown in FIG. 16 (the inner diameter) is smaller than the diameter of the anode 12 shown in FIG. 4 (the inner diameter). Therefore, according to the electrodynamics, the intensity of electric field ($|\Delta V/\Delta r|$) is decided based on a distance (Ar) between two points and a potential difference ($\Delta V$) between the two points. Comparing with the first embodiment, if the voltage supplied to the anode 12 is the same, the electric field in the neighborhood of the anode 12 increases. As a result, it is possible to generate a larger Hall current.

Note that the anode 12 may be arranged as follows. In an example of FIG. 16, the arrangement of the anode 12 is biased to one of the ends of the inner circumference side wall section $\mathbf{101}_2$ but the anode 12 may be arranged at the center of the inner circumference side wall section $\mathbf{101}_2$. In the example of FIG. 16, the anode 12 is arranged directly on the inner circumference side wall section $\mathbf{101}_2$, but for example, a thin spacer may be arranged between both. Also, the anode 12 may be provided on the outer circumference side wall section $\mathbf{101}_1$ in addition to the arrangement on the inner circumference side wall section $\mathbf{101}_2$.

5. Fourth Embodiment

Figure 17:
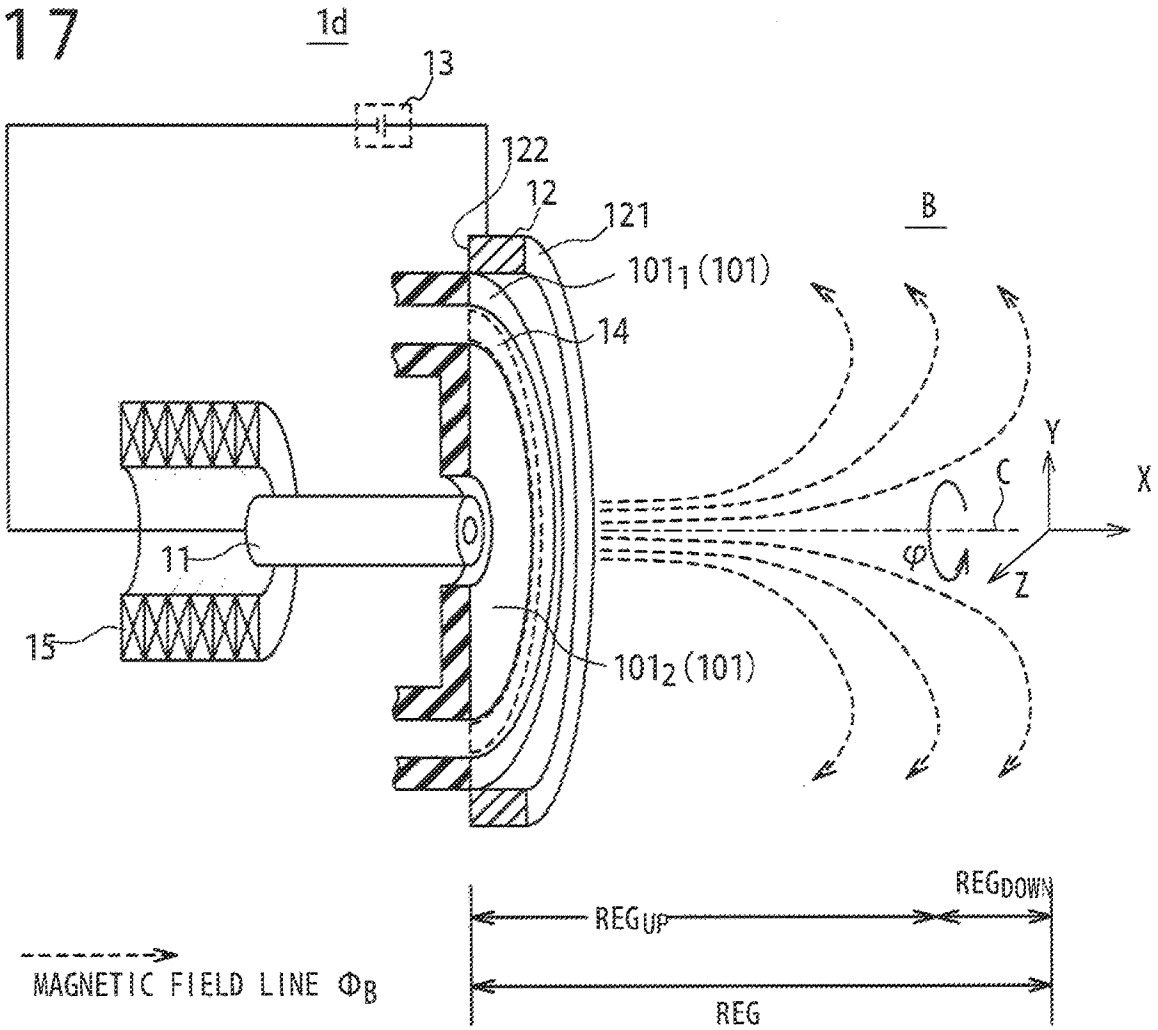
FIG. 17 is a partially cut perspective view schematically showing a configuration example of a plasma accelerating apparatus 1*d*.

The fourth embodiment is related to the arrangement of the first magnetic field generator and the arrangement of the anode. In the above-mentioned first embodiment, the cathode is arranged on the inner circumference side than the first magnetic field generator (coil). The first magnetic field generator as an electromagnetic coil may be arranged as follows. FIG. 17 is a partially cut perspective view schematically showing a configuration example of the plasma accelerating apparatus 1*d*. In an example of FIG. 17, the first magnetic field generator 15 is arranged on the upstream side than the cathode 11. The diameter of the anode 12 (inner diameter) is larger than the diameter (inner diameter) of the anode shown in FIG. 10. Moreover, the gas supply port 14 is not covered with a part of the upstream side end surface 122 of the anode 12 in the position separated from the gas supply port 14 in the forward direction on the X axis. The fourth embodiment attains the same effect as the effect of the first embodiment, the second embodiment or the third embodiment.

Note that the first magnetic field generator 15 may be arranged on the upstream side than the cathode 11 and the anode 12 may be arranged as shown in FIG. 4. Contrary to this, the first magnetic field generator 15 may be arranged as shown in FIG. 4, and the diameter (inner diameter) of the anode 12 may be larger than the diameter (inner diameter) of the anode shown in FIG. 10.

6. Fifth Embodiment

Figure 18:
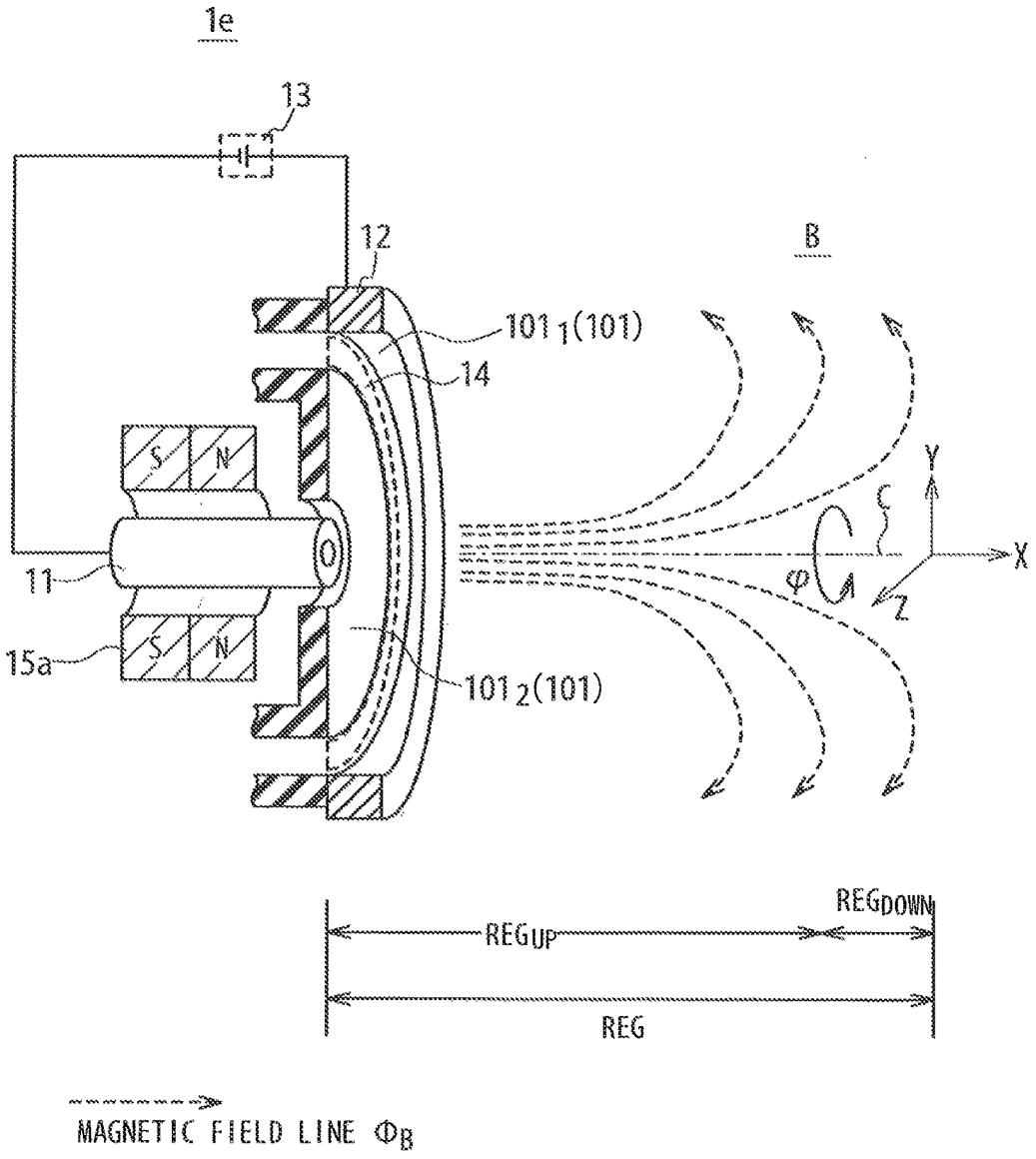
FIG. 18 is a partially cut perspective view schematically showing a configuration example of a plasma accelerating apparatus 1*e*.

The fifth embodiment is related to a case where a permanent magnet is applied to the first magnetic field generator. FIG. 18 is a partially cut perspective view schematically showing a configuration example of the plasma accelerating apparatus 1*e*. In an example of FIG. 18, as the permanent magnet, a ring magnet 15*a* is used. The side of the N pole of the ring magnet 15*a* faces to the first wall section 101. The cathode 11 is arranged on the inner circumference side than the ring magnet 15*a*. The fifth embodiment, too, attains the same effect as the effect of the first embodiment, the effect of the second embodiment or the effect of the third embodiment. Note that when the fifth embodiment is combined with the second embodiment shown in FIG. 15 (the method of using a plurality of magnetic field generators), it is desirable that the magnetic field generators ($\mathbf{15}_2$-$\mathbf{15}_5$) except for the ring magnet 15*a* are the electromagnetic coils for which it is possible to control the turning on/off of the generation of magnetic field. Also, in the example of FIG. 18, the ring magnet 15*a* is provided on the inner circumference side than the gas supply port 14. However, the ring magnet 15*a* may be provided on the outer circumference side than the gas supply port 14.

7. Sixth Embodiment

Figure 19:
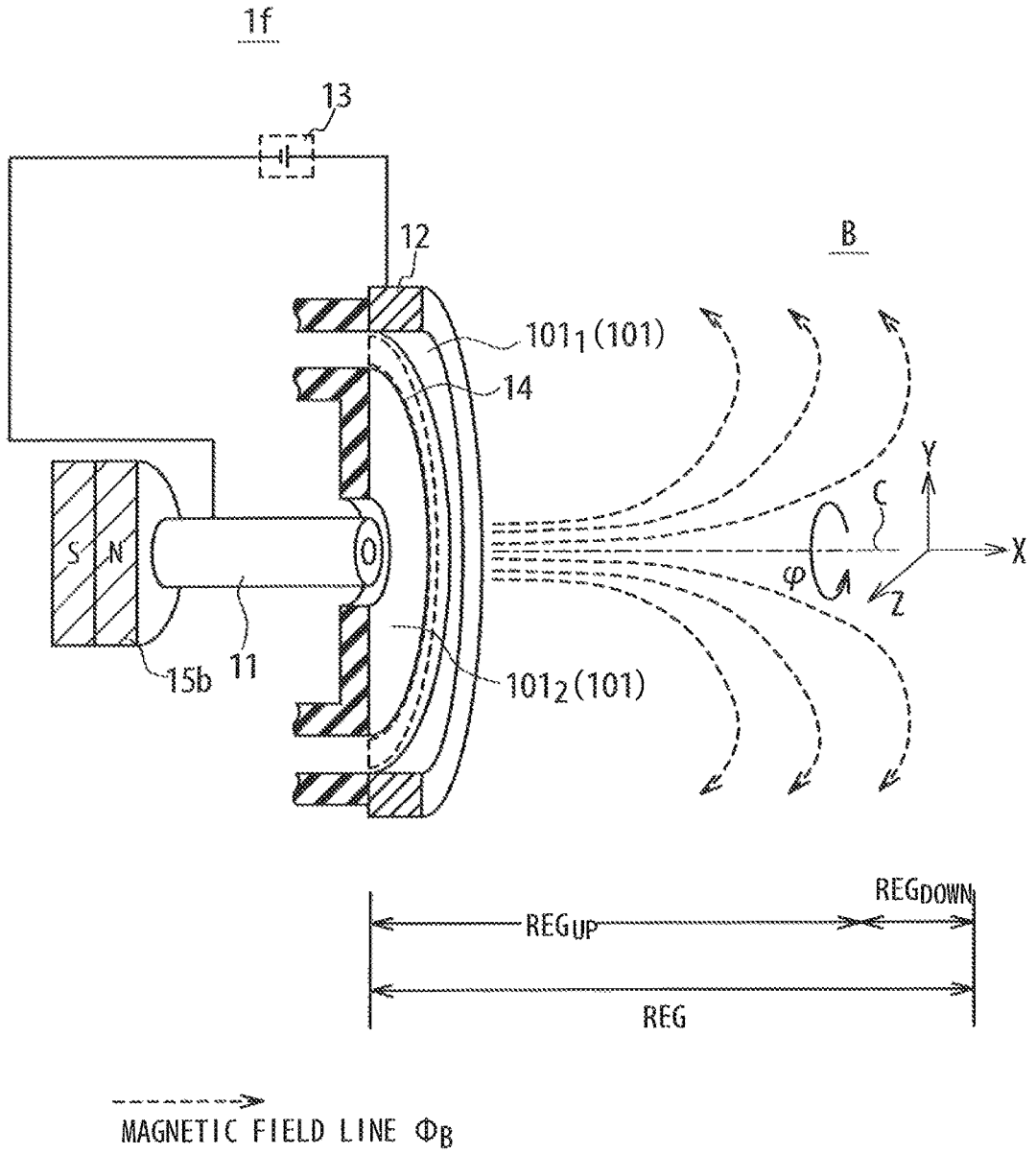
FIG. 19 is a partially cut perspective view schematically showing a configuration example of a plasma accelerating apparatus 1*f*.

The sixth embodiment is related to the arrangement of the permanent magnet described in the fifth embodiment. The permanent magnet may be arranged as follows. FIG. 19 is a partially cut perspective view schematically showing a configuration example of the plasma accelerating apparatus 1*f*. In an example of FIG. 19, as the permanent magnet, the column-type magnet 15*b* is used. The column-type magnet 15*b* is arranged on the upstream side than the cathode 11. The side of the N pole of the column-type magnet 15*b* faces to the first wall section 101. The sixth embodiment, too, attains the same effect as the effect of the first embodiment, the effect of the second embodiment or the effect of the third embodiment. Note that when the sixth embodiment is combined with the second embodiment shown in FIG. 15 (the method of using a plurality of magnetic field generators), it is desirable that the magnetic field generators ($\mathbf{15}_2$-$\mathbf{15}_5$) except for the column-type magnet 15*b* are the electromagnetic coils for which it is possible to control the turning on/off of the generation of magnetic field.

8. Seventh Embodiment

Figure 20:
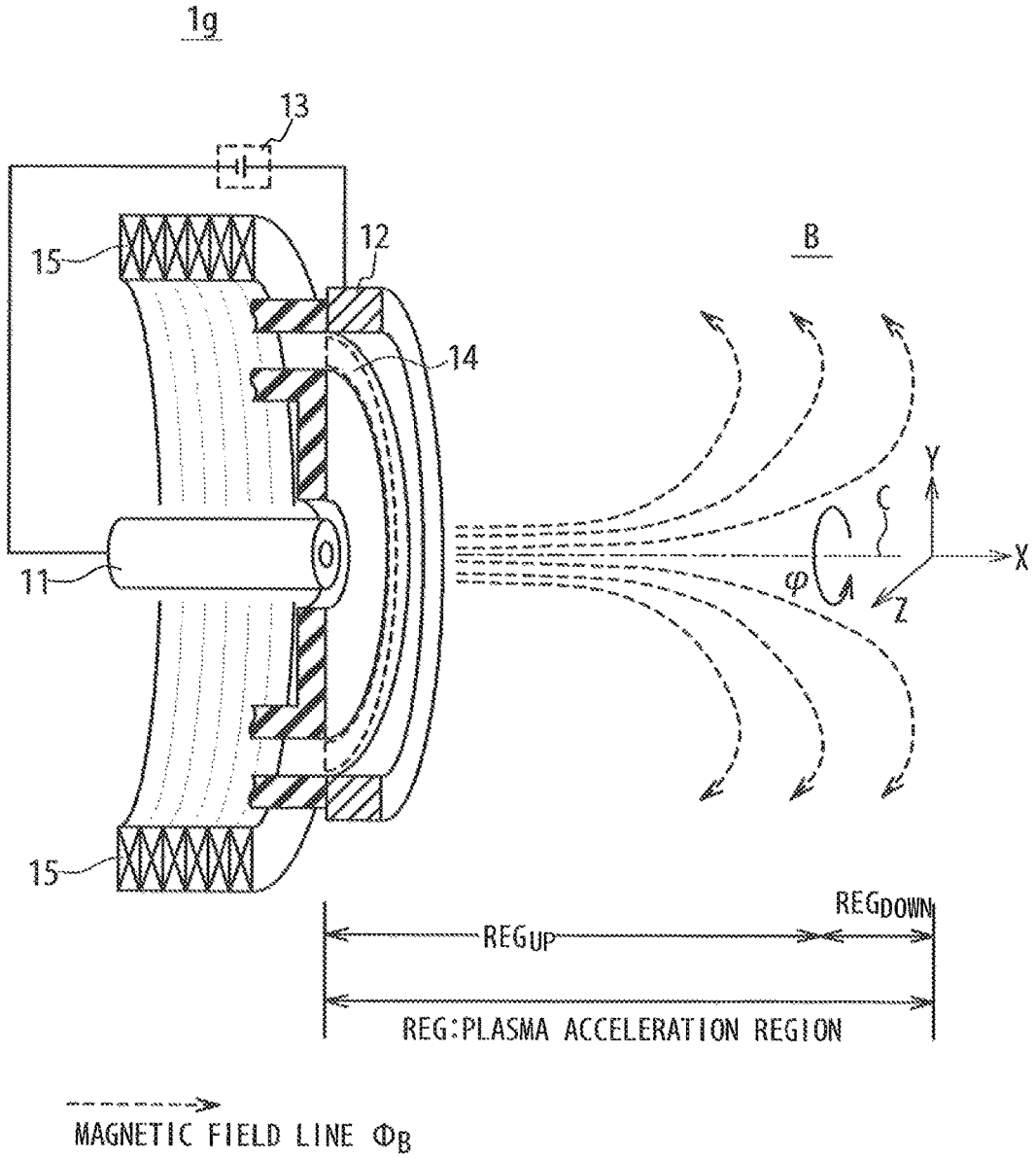
FIG. 20 is a partially cut perspective view schematically showing a configuration example of a plasma accelerating apparatus 1*g*.

The seventh embodiment is related to the arrangement of the first magnetic field generator. In the first embodiment, the first magnetic field generator is arranged on the inner circumference side than the gas supply port. The first magnetic field generator as the electromagnetic coil may be arranged as follows, FIG. 20 is a partially cut perspective view schematically showing a configuration example of a plasma accelerating apparatus 1*g*. In an example of FIG. 20, the gas supply port 14 is arranged on the outer circumference side than the cathode 11 and the first magnetic field generator 15 is arranged on the outer circumference side than the gas supply port 14. In other words, the cathode 11 and the gas supply port 14 are arranged on the inner circumference side than the first magnetic field generator 15. Therefore, the diameter of the first magnetic field generator 15 shown in FIG. 20 (the inner diameter) is larger than the diameter of the first magnetic field generator 15 shown in FIG. 4 (the inner diameter). Also, in the example of FIG. 20, the diameter of the first magnetic field generator 15 (the inner diameter) is larger than the diameter of the anode 12 (the inner diameter). When the diameter (the inner diameter) of the first magnetic field generator 15 is larger than the diameter of the anode 12 (the inner diameter), a part of the first magnetic field generator 15 may surround a part of the plasma acceleration region REG. Alternatively, the diameter of the first magnetic field generator 15 (the inner diameter) may be the same as the diameter of the anode 12 (the inner diameter). The seventh embodiment, too, attains the same effect as the effect of the first embodiment, the effect, of the second embodiment or the effect of the third embodiment.

9. Eighth Embodiment

Figure 21:
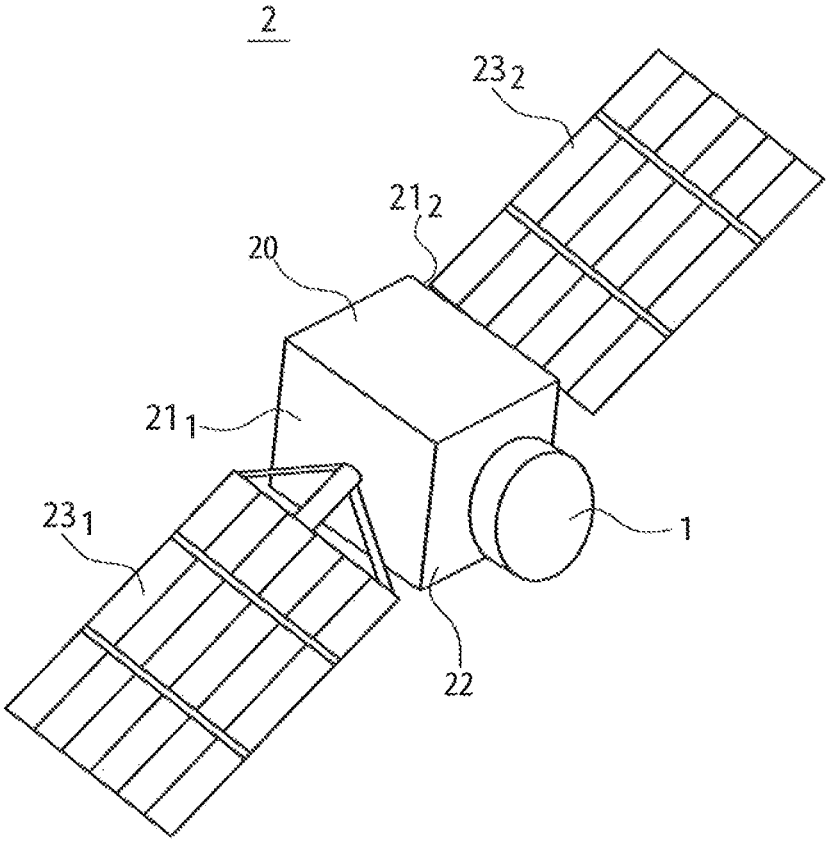
FIG. 21 is a diagram schematically showing a configuration example of a spacecraft 2.

An eighth embodiment is related to an application example of the plasma accelerating apparatus. The plasma accelerating apparatus described in the above-mentioned first to seventh embodiments can be applied to a spacecraft. FIG. 21 is a diagram schematically showing a configuration example of the spacecraft 2. In an example shown in FIG. 21, the spacecraft 2 has the plasma accelerating apparatus 1 (either of from 1*a* to 1*g*), a fuselage 20, a first solar cell $\mathbf{23}_1$ and a second solar cell $\mathbf{23}_2$. The plasma accelerating apparatus 1 is installed in the rear surface 22 of the fuselage 20. The first solar cell $\mathbf{23}_1$ is installed in the first side $\mathbf{21}_1$ of fuselage 20. The second solar cell $\mathbf{23}_2$ is installed in a second side $\mathbf{21}_2$ of the fuselage 20. By emitting an ion beam from the plasma accelerating apparatus 1, the track of the spacecraft 2 and the attitude of the spacecraft 2 can be changed. Note that the plasma accelerating apparatus 1 of equal to or more than two may be installed on the rear surface 22 of the fuselage 20.

As such, all the embodiments have been described. Various modifications can be applied to the present invention without deviating from the gist of the present invention. Unless the technical contradiction occurs, all the embodiments can be combined suitably.

The invention claimed is:

1. A plasma accelerating apparatus comprising:

a cathode configured to emit electrons to a direction of a predetermined center axis to supply the electrons to an upstream side region of a plasma acceleration region;

an anode having a ring shape when viewing from the direction of the center axis and arranged around the center axis;

a power supply configured to apply a voltage between the cathode and the anode;

a supply port arranged on an outer circumference side of the cathode to supply a propellant before plasmatization or a propellant after plasmatization to the plasma acceleration region; and a first magnetic field generator arranged in a second direction from the plasma acceleration region when a motion direction of the electrons emitted from the cathode is defined as a first direction and a direction opposite to the first direction is defined as the second direction, and configured to generate a first axial direction magnetic field in the upstream side region of the plasma acceleration region to suppress that the electrons supplied from the cathode from heading for the anode, wherein the first axial direction magnetic field has an axial direction component which is a component parallel to the center axis and monotonously degreases as heading for the first direction from the second direction on the center axis in the upstream side region of the plasma acceleration region, and a radial direction component which is a component orthogonal to the center axis and monotonously increases as heading for the first direction from the second direction on the center axis in the upstream side region of the plasma acceleration region, and wherein the first magnetic field generator is arranged in the second direction from the supply port.

2. The plasma accelerating apparatus according to claim 1, wherein the first magnetic field generator is arranged in the second direction from an end of the plasma acceleration region in the second direction.

3. The plasma accelerating apparatus according to claim 1, wherein the first magnetic field generator is arranged on the outer circumference side of the cathode, and wherein the supply port is arranged on the outer circumference side of the first magnetic field generator.

4. The plasma accelerating apparatus according to claim 1, wherein the supply port is arranged on the outer circumference side of the cathode, and wherein the first magnetic field generator is arranged on the outer circumference side of the supply port.

5. The plasma accelerating apparatus according to claim 1, further comprising:

an orientation changing mechanism configured to change an orientation of the first magnetic field generator.

6. The plasma accelerating apparatus according to claim 1, further comprising:

a second magnetic field generator configured to generate a second axial direction magnetic field in the plasma acceleration region, wherein a direction of the second axial direction magnetic field generated by the second magnetic field generator is different from the direction of the first axial direction magnetic field generated by the first magnetic field generator.

7. The plasma accelerating apparatus according to claim 1, further comprising:

a first wall section in contact with the plasma acceleration region;

an electron emission port arranged in the first wall section to emit the electrons supplied from the cathode.

8. The plasma accelerating apparatus according to claim 7, wherein the anode is arranged on the first wall section.

9. The plasma accelerating apparatus according to claim 1, wherein the anode is arranged on the outer circumference side of the supply port.

10. The plasma accelerating apparatus according to claim 1, further comprising:

a first wall section in contact with the plasma acceleration region, wherein the anode has a ring shape, and wherein a distance between the first wall section and a downstream side end surface of the anode is equal to or less than ⅓ of the inner diameter of the anode.

11. A plasma accelerating method comprising:

providing a plasma accelerating apparatus, wherein the plasma accelerating apparatus comprises:

a cathode configured to emit electrons to a direction of a predetermined center axis to supply electrons to a plasma acceleration region;

an anode having a ring shape when viewing from the direction of the center axis and arranged around the center axis; and a magnetic field generator arranged in a second direction from the plasma acceleration region, when a first direction is defined as a direction of movement of the electrons emitted from the cathode, and the second direction is defined as a direction opposite to the first direction;

generating a fan-shaped magnetic field in the plasma acceleration region by using the magnetic field generator;

applying a voltage between the cathode and the anode;

carrying out a first supply of supplying the electrons supplied from the cathode into the fan-shaped magnetic field;

carrying out a second supply of supplying a propellant before plasmatization or a propellant after plasmatization into the plasma acceleration region for the first direction from a supply port;

accelerating ions in a plasma generated in the plasma acceleration region by using an electric field generated by the anode and the electrons in the fan-shaped magnetic field so as to be focused for the center axis; and neutralizing the ions through collision of the ions and the electrons in the fan-shaped magnetic field, wherein the fan-shaped magnetic field has an axial direction component which is a component parallel to the center axis and monotonously degreases as heading for the first direction from the second direction on the center axis in the upstream side region of the plasma acceleration region, and a radial direction component which is a component orthogonal to the center axis and monotonously increases as heading for the first direction from the second direction on the center axis in the upstream side region of the plasma acceleration region, and wherein the magnetic field generator is arranged in the second direction from the supply port.

12. The plasma accelerating method according to claim 11, further comprising:

generating a Hall current through interaction of a fan-shaped magnetic field and an electric field generated between the cathode and the anode; and generating a plasma in the plasma acceleration region through collision of a propellant before plasmatization or a propellant after plasmatization supplied into the plasma acceleration region and the electrons of the Hall current.

* * * * *